US006756532B2

(12) United States Patent
Wachi et al.

(10) Patent No.: US 6,756,532 B2
(45) Date of Patent: Jun. 29, 2004

(54) WAVEFORM SIGNAL GENERATION METHOD WITH PSEUDO LOW TONE SYNTHESIS

(75) Inventors: Masatada Wachi, Hamamatsu (JP); Masahiro Shimizu, Hamamatsu (JP); Tsuyoshi Futamase, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/865,954

(22) Filed: May 25, 2001

(65) Prior Publication Data

US 2001/0049994 A1 Dec. 13, 2001

(30) Foreign Application Priority Data

May 30, 2000 (JP) ..... 2000-159478

(51) Int. Cl.[7] ..... G10H 7/00

(52) U.S. Cl. ..... 84/604; 84/616; 84/622; 84/633

(58) Field of Search ..... 84/600–606, 615–616, 84/622–627, 633, 653–654, 659–663, 665

(56) References Cited

U.S. PATENT DOCUMENTS 4,453,223 A * 6/1984 Ravel ..... 364/517
4,554,857 A 11/1985 Nishimoto
4,584,921 A 4/1986 Wachi
4,924,744 A * 5/1990 Yamamura ..... 84/601
5,519,166 A * 5/1996 Furuhashi et al. ..... 84/603
5,756,919 A * 5/1998 Adachi et al. ..... 84/660
5,814,750 A * 9/1998 Wang et al. ..... 84/602
5,930,373 A 7/1999 Shashoua et al.

FOREIGN PATENT DOCUMENTS

| | | |
|---|---|---|
| EP | 0546619 A2 | 6/1993 |
| EP | 0729287 A2 | 8/1996 |
| WO | WO 97/42789 | 11/1997 |
| WO | WO 00/14998 | 3/2000 |

* cited by examiner

*Primary Examiner*—Marlon T. Fletcher
(74) *Attorney, Agent, or Firm*—Morrison & Foerster LLP

(57) ABSTRACT

A method generates waveform signals from a plurality of channels to sound a music tone through an electro-acoustic converter in response to sounding instruction information. The method is carried out by a receipt process of receiving the sounding instruction information containing a designated pitch effective to specify a pitch of the music tone, a determination process of determining whether or not the designated pitch is lower than a critical pitch which is predetermined in association with the electro-acoustic converter, a first generation process of generating a first waveform signal containing a fundamental tone corresponding to the designated pitch at least when the determination process determines that the designated pitch is not lower than the critical pitch, and a second generation process of generating a second waveform signal containing at least two overtones which are multiples of the fundamental tone and higher than the critical pitch, only when the determination process determines that the designated pitch is lower than the critical pitch, thereby the second waveform signal providing a pseudo low tone below the critical pitch.

24 Claims, 21 Drawing Sheets

EQUAL LOUDNESS CONTOUR OF FLETCHER & MONSON

EQUAL LOUDNESS CONTOUR OF ROBINSON & DODSON

WAVEFORM SIGNAL GENERATION METHOD WITH PSEUDO LOW TONE SYNTHESIS

BACKGROUND OF THE INVENTION

The present invention relates to a waveform signal generation method, a waveform signal generation apparatus and a storage medium used for an apparatus generating a musical tone signal such as an electronic instrument a portable phone, an amusement machine and others. In particular, the present invention relates to a waveform signal generation method, a waveform signal generation apparatus and a storage medium which are preferable for use in a compact device among these devices.

In an electronic instrument, a portable phone, an amusement machine and others, a musical tone signal is sounded through a built-in or external electo-acoustic converter (speaker and the like). Here, a range of sounds which can be converted has a predetermined limit. In particular, as to a low note, only sounds above a lowest frequency (which will be referred to as a "lowest frequency" or a "reproducible lowest frequency" hereinafter) specified by a lowest resonance frequency of the electo-acoustic converter can be sounded.

In order to solve this problem, there is known a technique for generating a "pseudo low tone". This is a technique utilizing an illusion of human sense such that generating audio signals having given two frequencies enables a human to hear a signal corresponding the greatest common factor of these frequencies. For example, in order to generate the "pseudo low tone" having 100 Hz by a speaker which cannot output an audio signal having 100 Hz, generation of two frequencies whose greatest common factor is 100 Hz, for example, "200 Hz and 300 Hz", "300 Hz and 400 Hz" and others can suffice.

For example, U.S. Pat. No. 5,930,373 discloses this technique in detail. According to this technique, in digital audio signals sequentially supplied, filtering process is applied to components which cannot be reproduced by the speaker, and a frequency component which is twofold, threefold, . . . of these frequency components is generated. The thus generated frequency components and the original audio signal are mixed with each other to be sounded through the speaker.

In the technique disclosed in the above-described U.S. patent, however, since processing such as multiplication must be executed in accordance with each sampling cycle with respect to the sequentially supplied digital audio signal, a large volume of calculations are required in order to generate a pseudo low tone. In an electronic instrument and the like, since diverse kinds of processing must be performed besides generation of the pseudo low tone, the throughput capacity allocated for generation of the pseudo low tone itself has a limit.

SUMMARY OF THE INVENTION

In view of the above-described problems, it is an object of the present invention to provide a waveform signal generation method, a waveform signal generation apparatus and a storage medium for reducing a processing load required for generating a pseudo low tone. It is another object of the present invention to provide an audio signal generation method, an audio signal generation apparatus and a storage medium capable of generating a pseudo low tone in a natural state.

In order to solve the above-described problems, the present invention comprises the following structure. Namely, there is provided a method of generating waveform signals from a plurality of channels to sound a music tone through an electro-acoustic converter in response to sounding instruction information. The inventive method is carried out by a receipt process of receiving the sounding instruction information containing a designated pitch effective to specify a pitch of the music tone, a determination process of determining whether or not the designated pitch is lower than a critical pitch which is predetermined in association with the electro-acoustic converter, a first generation process of generating a first waveform signal containing a fundamental tone corresponding to the designated pitch at least when the determination process determines that the designated pitch is not lower than the critical pitch, and a second generation process of generating a second waveform signal containing at least two overtones which are multiples of the fundamental tone and higher than the critical pitch, only when the determination process determines that the designated pitch is lower than the critical pitch, thereby the second waveform signal providing a pseudo low tone below the critical pitch.

Preferably, the first generation process generates the first waveform signal from a first channel even when the determination process determines that the designated pitch is lower than the critical pitch, and concurrently the second generation process generates the second waveform signal from a second channel different than the first channel, so that the first waveform signal and the second waveform signal are mixed with each other to provide the music tone containing the pseudo low tone.

Preferably, the first generation process generates the first waveform signal by reading out first prestored waveform data and the second generation process generates the second waveform signal by reading out second prestored waveform data, the method further comprising a mix process of mixing the first waveform signal and the second waveform signal with each other when the determination process determines that the designated pitch is lower than the critical pitch, thereby providing the music tone containing the pseudo low tone.

Preferably, the first generation process does not generate the first waveform signal when the determination process determines that the designated pitch is lower than the critical pitch, while the second generation process generates the second waveform signal containing the first waveform signal as well as the overtones, thereby providing the music tone containing the pseudo low tone.

Preferably, the first generation process generates the first waveform signal by reading out first waveform data which is prestored and the second generation process generates the second waveform signal by reading out second waveform data which is a mixture of the first waveform data and additional waveform data corresponding to the overtones.

Preferably, the first generation process generates the first waveform signal according to a waveform generation algorithm constituted by a plurality of operators, and the second generation process generates the second waveform signal according to another waveform generation algorithm constituted by a plurality of operators, the second generation process generating the overtones through a parallel connections of the operators assigned to the respective ones of the overtones. In such a case, the first generation process generates the first waveform signal by using operators belonging to a first channel, and the second generation process generates the second waveform signal by using operators belonging to a second channel different than the first channel.

There is provided another method of generating first and second waveform signals to output a music tone containing a pseudo low tone audible below a critical pitch. The inventive method is carried out by a generation process of generating the second waveform signal which corresponds to the pseudo low tone and which differs from the first waveform signal corresponding to the music tone, a coefficient generation process of generating a coefficient which gradually decreases in a predetermined pitch range around the critical pitch as a frequency of the second waveform signal increases, a control process of controlling a level of the second waveform signal according to the generated coefficient, and an output process of outputting the second waveform signal concurrently with the first waveform signal, thereby providing the music tone and the pseudo low tone which fades out as a pitch of the music tone rises.

Preferably, the inventive method further includes an allocation process of allocating a channel to the waveform generation process and setting the allocated channel with tone generation parameters corresponding to the first waveform signal, wherein the output process commands the allocated channel to generate the second waveform signal containing the first waveform signal.

Preferably, the waveform generation process comprises the steps of extracting a fundamental tone component from the first waveform signal which are provided sequentially, and generating at least overtone components of the extracted fundamental tone components so as to provide the pseudo low tone.

DETAILED DESCRIPTION OF THE EMBODIMENT

1. First Embodiment

1.1. Principle of Embodiment

1.1.1. Analysis of Components of Waveform

In this embodiment, since musical tone waveforms is separated into a "periodic component" and a "noise component" the detail of these components will be explained. Subjecting the musical tone waveform of a natural instrument to FFT (fast Fourier transformation) analysis, the frequency components of this musical tone waveform can be separated into a frequency component which is continuous on a time axis and a frequency component which is intermittent on the time axis. When the waveform synthesis is carried out based on the former frequency component, a "periodic component" of the musical tone waveform can be obtained. Further, when the waveform synthesis is performed based on the latter frequency component, a "noise component" of the musical tone waveform can be obtained.

Figure 6A:
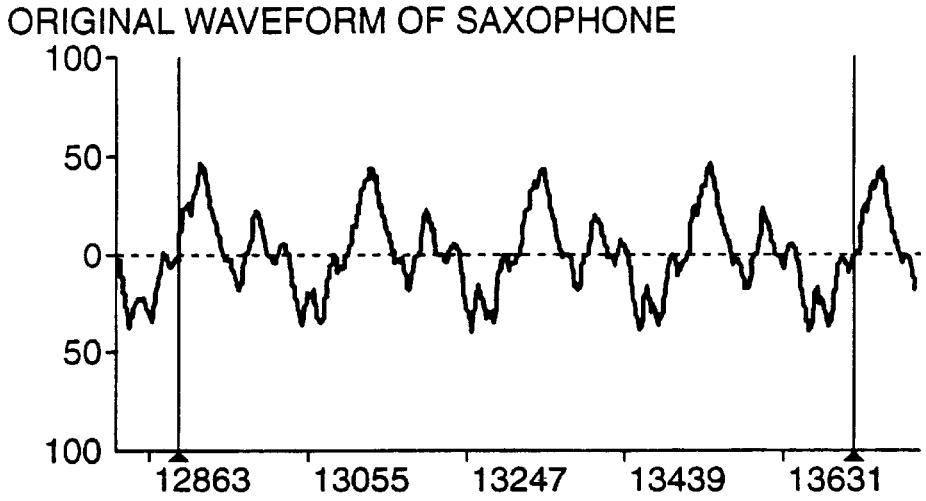
FIG. 6 is a view showing a waveform component analysis result.
Figure 6B:
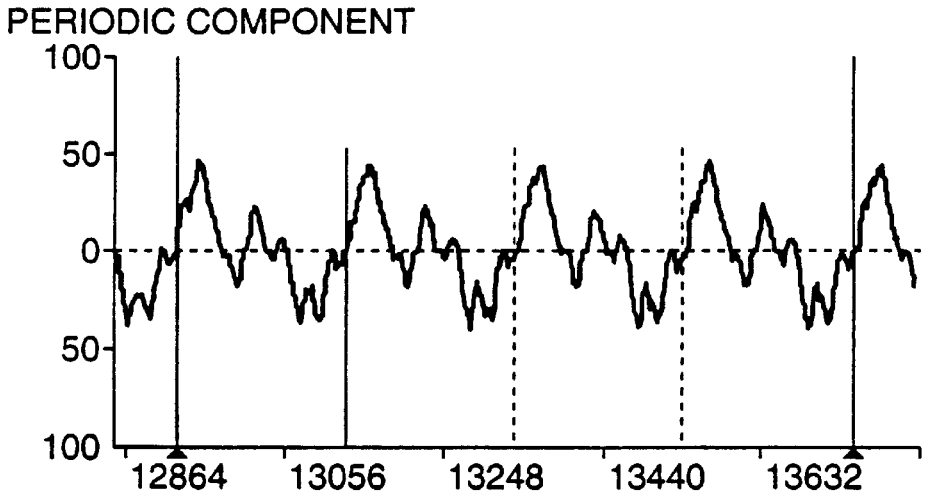
Figure 6C:
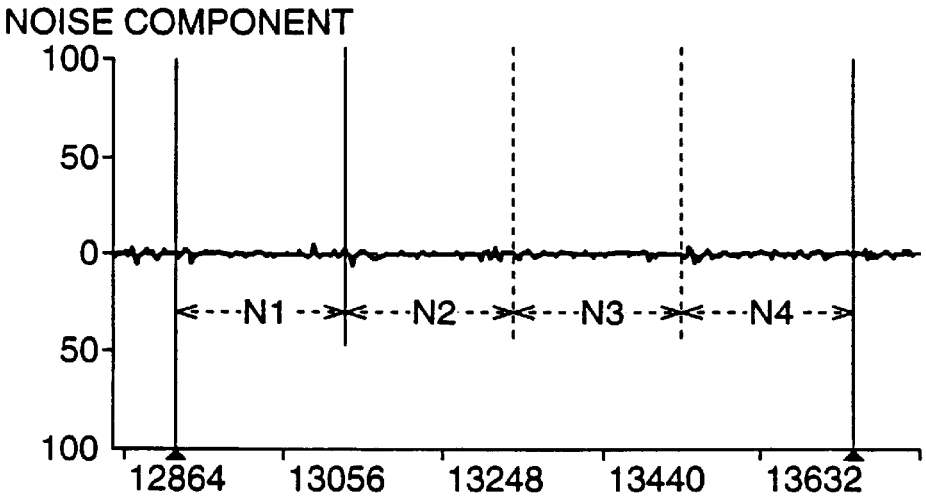

FIG. 6 shows one example thereof. FIG. 6(*a*) shows a musical tone waveform (original waveform) of a saxophone. FIG. 6(*b*) shows its periodic component, and FIG. 6(*c*) shows its noise component. As apparent from these drawings, the noise component has an interval in which a large amplitude level is attained being short, and it is often the case that the noise component is dispersed in a wider frequency range than the periodic component of the musical tone signal. Therefore, the performance of an electo-acoustic converter rarely becomes a matter, and it can be understood that only the pseudo low tone should be generated for only the periodic component according to needs.

1.1.2. Equal Loudness Contour

Figure 5A:
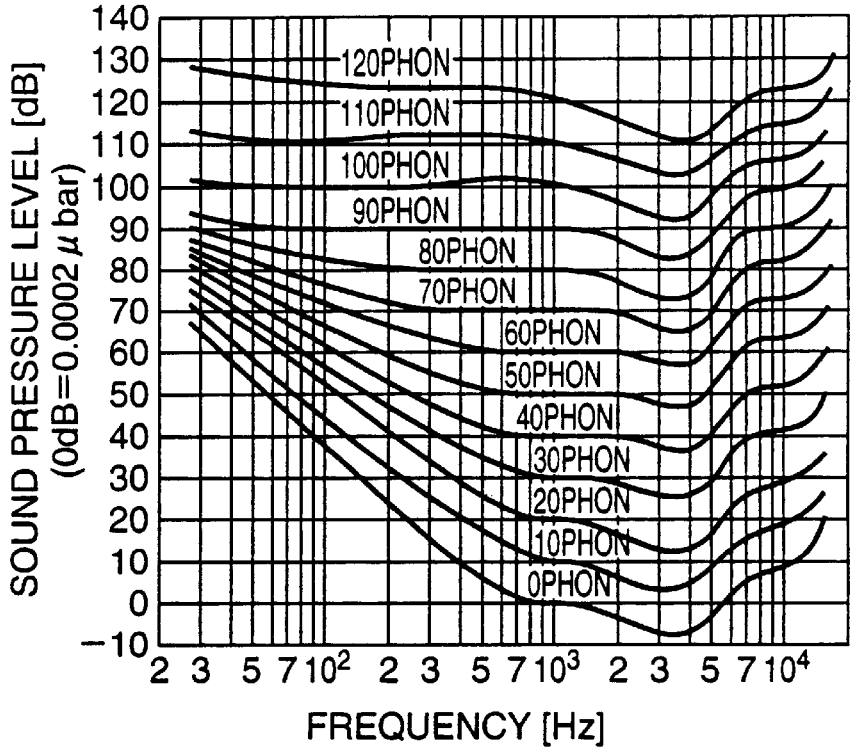
FIG. 5 is a view showing an equal loudness contour.
Figure 5B:
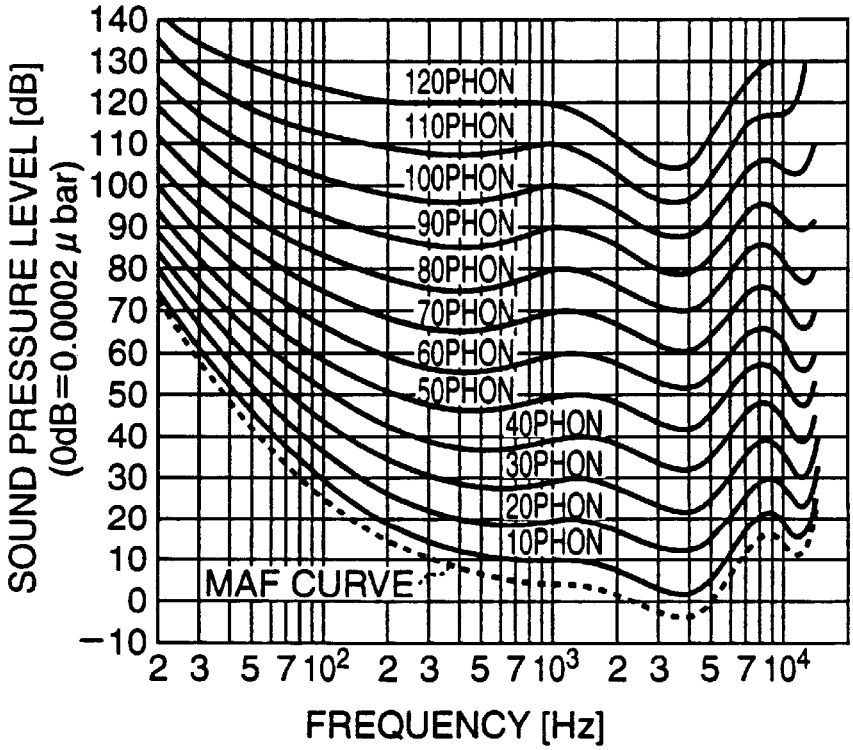

Even though a sound pressure level is fixed, different frequencies cause the sound to be heard as if a sound volume sense is changed with a human acoustic sense. Thus, when a sound pressure level curve is drawn on a graph having a horizontal axis representing a frequency and a vertical axis representing a sound pressure level such that the equal sound volume (loudness) points are connected, the characteristics as shown in FIGS. 5(*a*) and (*b*) can be obtained. These characteristics are referred to as an "equal loudness contour". FIG. 5(*a*) is called a "Fletcher & Manson's equal loudness contour" and relatively old. FIG. 5(*b*) is called a "Robinson & Dodson's equal loudness contour" and relatively new. This is also adopted in ISO.

1.2. Hardware Structure of Embodiment

Figure 1:
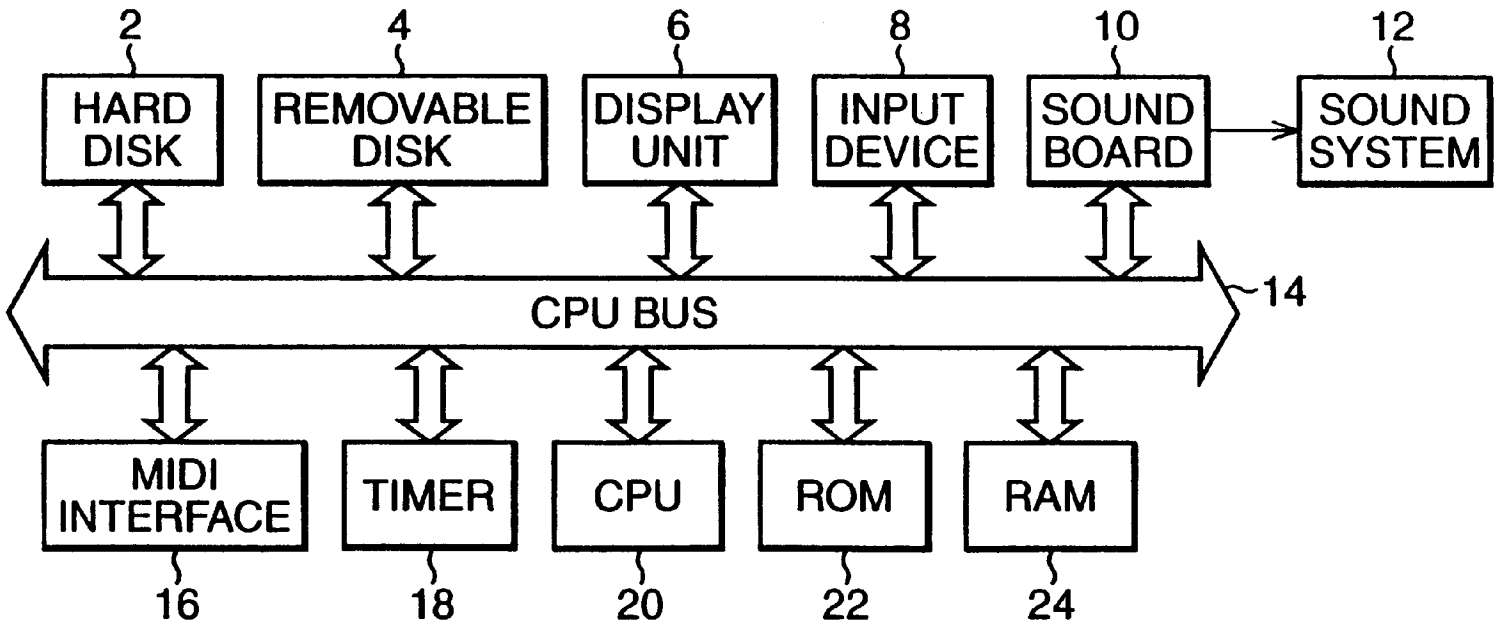
FIG. 1 is a hardware block diagram of a musical tone synthesis system of a first embodiment according to the present invention.

A hardware structure of a musical tone synthesis system according to a first embodiment of the present invention will now be described with reference to FIG. 1. It is to be noted that the hardware of this embodiment is constituted by a general purpose personal computer. In FIG. 1, reference numeral 2 denotes a hard disk for storing an operating system, an application program for the musical tone synthesis system, waveform data and other various kinds of data. Reference numeral 4 designates a removable disk such as a CD-ROM or a DVD-RAM for storing information similar to those in the hard disk 2. Reference numeral 6 represents a display unit for display various kinds of information to a user.

Reference numeral 8 denotes an input device constituted by a keyboard, a mouse, a keyset and others, through which various types of information is inputted by a user. Reference numeral 10 designates a sound board constituted by a waveform memory type sound source for generating a musical tone signal based on supplied performance information and an AD converter for sampling an externally inputted analog signal. The musical tone signal generated by the sound source in the sound board 10 is sounded through a sound system 12. It is to be noted that the sound system 12 is constituted by an amplifier and an electo-acoustic converter. A speaker, a headphone and the like can be selected as the electo-acoustic converter, and they have different conversion characteristics.

Reference numeral 16 represents a MIDI interface which transmits/receives a MIDI signal to/from an external MIDI device. Reference numeral 18 denotes a timer for generating an interruption request at predetermined time intervals. Reference numeral 20 designates a CPU for controlling each portion of the musical tone synthesis system through a bus 14 based on a later-described control program. Reference numeral 22 represents a ROM for storing therein an initial program loader and others. Reference numeral 24 denotes a RAM used as a work memory of the CPU 20.

1.3. Operation of Embodiment 1.3.1. Waveform Data Generation Processing

Figure 3:
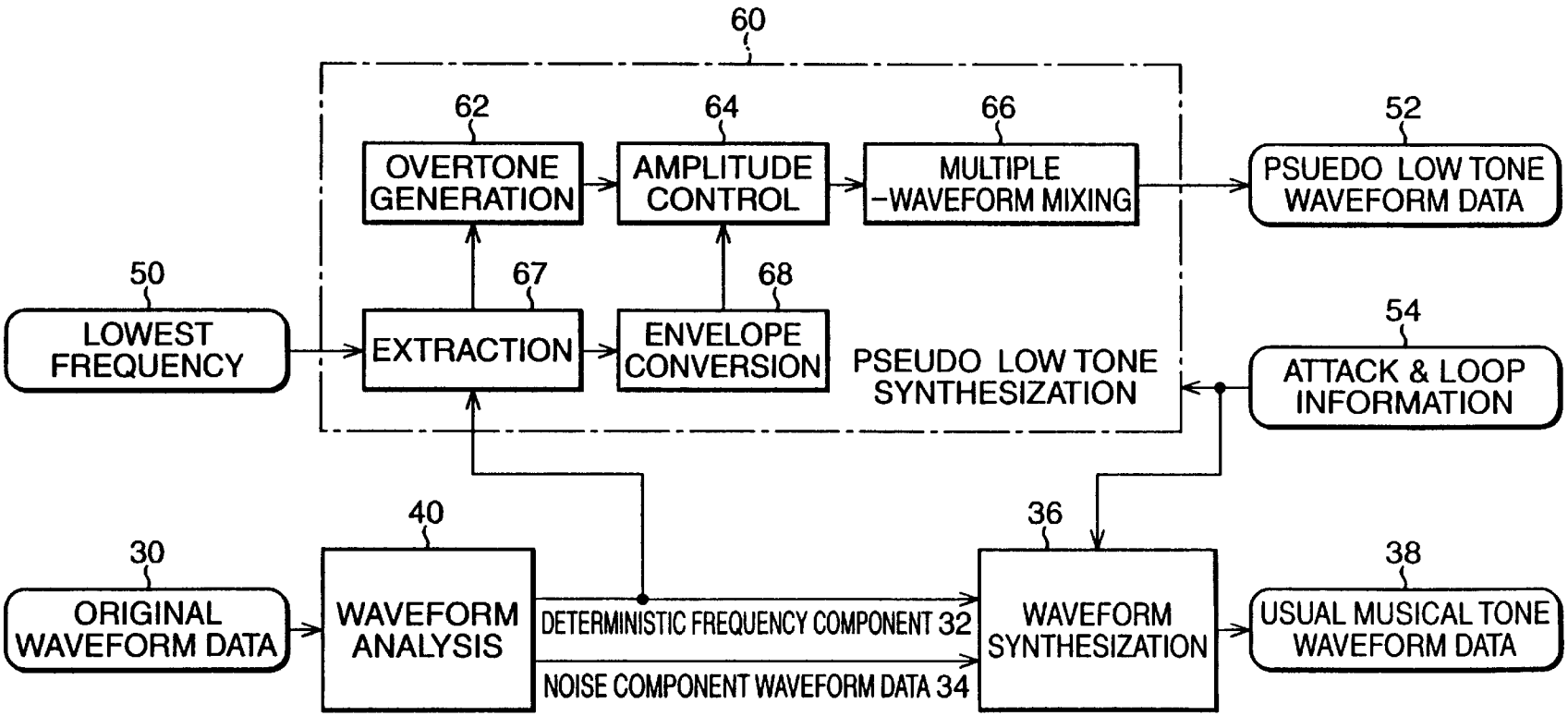
FIG. 3 is a block diagram showing details of waveform data generation processing in the first embodiment.

The operating system is booted on the personal computer, and the application program for a waveform analysis/synthesis system is activated. Thereafter, when a user carries out a predetermined operation, waveform data generation processing is executed. This processing will now be explained in detail with reference to FIG. 3. It is to be noted that FIG. 3 is a functional block diagram showing the substance of a processing program executed in the CPU 20.

In the drawing, reference numeral 30 denotes original waveform data such as a recorded waveform of a musical tone of a natural instrument, and this data is externally inputted through the sound board 10 or the removable disk 4 and the like. Reference numeral 40 designates a waveform analysis portion for classifying frequency components of the original waveform data 30 into a component continuous on the time axis (deterministic frequency component) and other fragmentary components (noise components). Here, the detail of the waveform analysis portion 40 will be explained with reference to FIG. 4. Reference numeral 42 denotes an FFT analysis processing portion in the waveform analysis portion 40, and the FFT analysis processing is carried out with respect to the original waveform data 30. Here, a windowing function whose length is eightfold of a pitch cycle of the original waveform data 30 is first applied to the original waveform data 30, and the frequency component is analyzed in a range of the windowing function.

A position of the windowing function is then shifted rearwards by only ⅛ of the pitch cycle on the time axis and the frequency component is similarly analyzed. When this processing is repeated with respect to the entire original waveform data, a change in the frequency component on the time axis can be obtained. Reference numeral 44 designates a continuous component separation portion for separating a component continuous on the time axis from a series of frequency components. The separated component is outputted as a deterministic frequency component 32 and supplied to the synthesis portion 46. In the synthesis portion 46, deterministic waveform data is synthesized based on the deterministic frequency component 32. Reference numeral 48 represents a subtraction portion for subtracting the deterministic waveform data from the original waveform data 30. A result of this subtraction is outputted as noise component waveform data 34.

Again referring to FIG. 3, reference numeral 54 denotes attack & loop information which is set while referring to the original waveform data 30 by a user. Alternatively, this information may be automatically set by using a result of the waveform analysis and the like in accordance with designation by a user. The content of the attack & loop information includes a length of an attack section which is read only once at the beginning of waveform reproduction, a length of a loop section which is repeatedly read after the length of the attach section. Reference numeral 36 designates a waveform synthesis portion for synthesizing waveform data of the attack section and the loop section based on the deterministic frequency component 32, the noise component waveform data 34, and the attack & loop information 54. The synthesized waveform data is usually stored as musical tone waveform data 38 in the hard disk 2 and the like.

Here, the outline of the synthesis processing in the waveform synthesis portion 36 is described. The attack & loop information 54 is first used to determine an attack start address indicative of a top of the attack section, and a loop start address and a loop end address indicative of a top and an end of the loop section.

Subsequently, from the deterministic frequency components of the loop section, a component having a value close to the loop start phase at the loop end is selected. The selected component is corrected in such a manner that the phase at the loop end is matched with the phase at the loop start. Incidentally, if the loop is a long loop (loop size which is not less than several hundred milliseconds), a component having a value which is not close to the loop start phase at the loop end (non-overtone component) may be also selected and corrected. Then, sine wave synthesis is carried out based on the corrected frequency component, and the waveform data of the loop section is generated.

A component which has not been used for the loop section among the deterministic frequency components of the attack section is then processed in such a manner that this component gradually faded out from the middle of the attack section to the end of the attack section, and the sine wave synthesis is executed based on the processed deterministic frequency components, thereby generating the waveform data of the attack section. Further, a sound volume of the noise component waveform data 34 is controlled meanwhile, and this is mixed in the attack section and the loop section.

The thus created waveform data of the attack section and the loop section has a waveform which is very similar to that of the original waveform data 30 and has good connections from the attack section to the loop section and from the loop end to the loop start.

Furthermore, reference numeral 60 designates a pseudo low tone synthesis portion for generating pseudo low tone waveform data 52 based on the lowest frequency data 50 indicative of a lowest frequency of the sound system 12, the deterministic frequency component 32 and the attack & loop information 54. Here, the lowest frequency data 50 may be one or a plurality of sets of preset frequencies or a frequency which can be arbitrarily set by a user utilizing an operator. Reference numeral 67 represents an extraction portion in the pseudo low tone synthesis portion 60 for extracting a frequency component which is not more than the lowest frequency or critical frequency from the deterministic frequency components 32. Reference numeral 62 denotes a overtone generation portion for generating a plurality of overtone components beyond the lowest frequency with respect to each extracted frequency component. Here, a frequency of the extracted frequency component fluctuates in time, and a frequency of the generated overtone components also fluctuates in accordance with that fluctuation.

If the lowest frequency is, for example, 120 Hz, the overtone components which are at least twofold and threefold of the frequency component of $60<f\leqq 120$ Hz in the deterministic frequency components 32 is generated. Similarly, the overtone components which are at least threefold and fourfold of the frequency component of $40<f\leqq 40$ Hz is generated, and the overtone components which are at least fourfold and fivefold of the frequency component of $30<f\leqq 40$ Hz is produced.

Reference numeral 68 denotes an envelope conversion portion for outputting an envelope of each overtone component in such a manner that the sound volume (loudness) of the pseudo low tone generated by each overtone component matches with the subjective sound volume of the original frequency component. Its content will now be described with reference to FIG. 7. At first, according to the equal loudness contours shown in FIGS. 5(*a*) and (*b*), it can be understood that a level of the overtone components must be reduced and a range of changes in the level must be increased in order to generate, in the overtone component (for example, 200 Hz and 300 Hz), the same sound volume sense as that in a low tone range (for example, 100 Hz).

Figure 7:
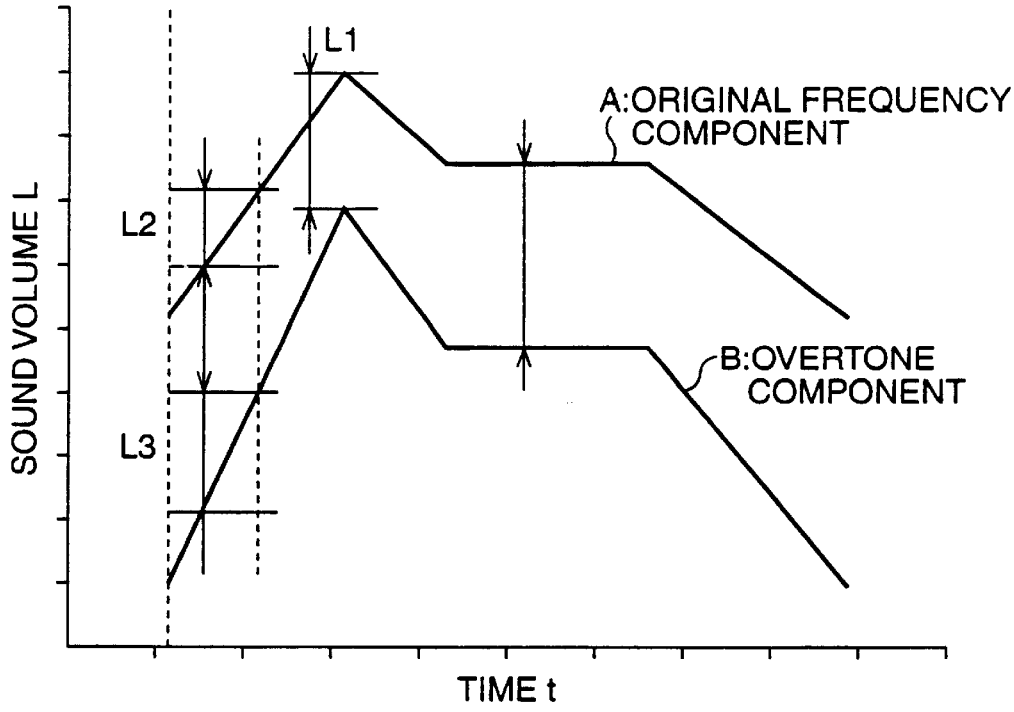
FIG. 7 is an envelope conversion characteristic view in the first embodiment.

If an envelope level of the extracted original frequency component is indicated by a characteristic A in FIG. 7, the envelope converter 68 converts this level into a level such as indicated by a characteristic B in FIG. 7 to be outputted as an envelope level of the overtone component. In the low tone range of the equal loudness contour in FIGS. 5(*a*) and (*b*), the sound pressure level of the equal loudness lowers 10 to 15 dB every time the frequency is doubled in each figure. Therefore, a level L1 in FIG. 7 is set to "10 to 15 dB×predetermined multiple". Furthermore, the magnitude of a change in the sound pressure level where a change in loudness becomes equal is approximately 1.4-fold in "Fletcher & Manson" and approximately 1.1-fold in "Robinson & Dodson" every time the frequency is doubled. Thus, a level ratio L3/L2 in the drawing is set to approximately "1.1 to 1.4×multiple factor".

Again referring to FIG. 3, reference numeral 64 designates an amplitude control portion for multiplying each overtone component outputted from the overtone generation portion 62 by an envelope level outputted from the envelope conversion portion 68. Reference numeral 66 represents a multiple-waveform mixing portion for mixing each overtone component to which the envelope has been applied. A result of this mixing is stored as the pseudo low tone waveform data 52 in the hard disk 2. The usual musical tone waveform data 38 generated in the above-described manner and the corresponding pseudo low tone waveform data 52 are transferred to a waveform memory in the sound board 10 as waveform data of a music tone defined by a user when the user performs a predetermined operation.

For the meantime, in general, the different usual musical tone waveform data 38 is stored in the waveform memory type sound source in accordance with each tone range of each timbre (waveform data may be commonly used among timbres and tone ranges). In this embodiment, for only the usual musical tone waveform data in which the fundamental wave component in the included deterministic frequency components is not more than the lowest frequency, the corresponding pseudo low tone waveform data 52 is stored in the waveform memory. Basically, storing the pseudo low tone waveform data with the usual musical tone waveform data 38 in one-to-one correspondence can suffice, but it is not necessary to store them in this way. In some cases, a plurality of sets of pseudo low tone waveform data may be stored with respect to one set of usual musical tone waveform data, or one set of pseudo low tone waveform data may be stored for a plurality of sets of usual musical tone waveform data. A desired pitch is realized by reading the usual musical tone waveform data 38 stored in the waveform memory at a speed based on an F number when forming the musical tone signal. Then, in this embodiment, a low frequency component which actually becomes irreproducible by the capability of the sound system 12 in the frequency components of the usual musical tone waveform data 38 varies in accordance with the F number. In this embodiment, therefore, a plurality of sets of pseudo low tone waveform data 52 are generated in accordance with each tone range.

For the above-mentioned reason, in this embodiment, the note range to which one set of the pseudo low tone waveform data 52 is applied has an inclination to be narrower than the tone range to which one set of the usual musical tone waveform data 38 is applied, and a number of sets of pseudo low tone waveform data 52 tend to increase. The memory region occupied by the pseudo low tone waveform data 52 can be extremely smaller than that of the usual musical tone waveform data 38 by suppressing the sampling frequency. Description will be given as to this reason.

At first, a general audio consumer appliance has a sampling frequency of the musical tone waveform which is approximately 32 to 48 kHz. That is because the upper limit of the reproduction frequency is set to approximately 15 to 20 kHz. On the other hand, as to the pseudo low tone waveform data 52, since it is good enough that the upper limit of the reproduction frequency is approximately 2 kHz (although it depends on the lowest frequency data 50), thereby assuring that the sampling frequency of approximately 5 t 10 kHz can suffice. Thus, a data quantity of one set of pseudo low tone waveform data 52 can be suppressed to approximately one/several dividends to one/dozen dividends of one set of the usual musical tone waveform data 38. Incidentally, when applying such a low sampling frequency, adoption of accurate interpolation between sampling points such as "eight-point interpolation" is preferable.

1.3.2. Waveform Synthesis Processing

After the waveform data is created as described above, when a MIDI event is inputted through the input device 8 or the MIDI interface 16, the musical tone waveform is synthesized in the sound source by controlling the waveform memory type sound source in the sound board 10 based on this input. Further, in case of reproducing an SMF (standard MIDI format) file supplied through the removable disk 4 and the like, the musical tone waveform is synthesized based on music event information. The details of this sound source control processing will now be described with reference to FIG. 2.

(1) When Pseudo low tone Effect is OFF

Figure 2A:
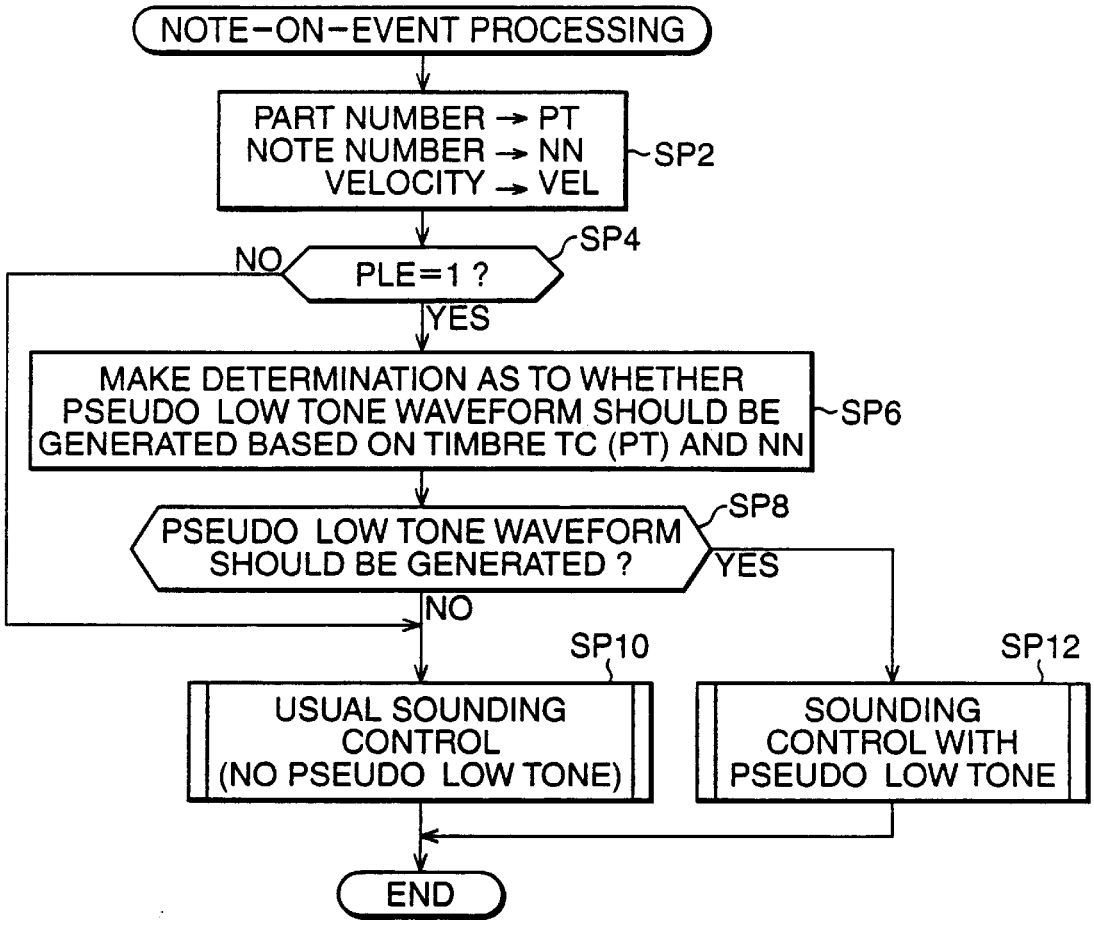
FIG. 2 shows flowcharts of a note-on-event processing routine and a usual sounding control subroutine.
Figure 2B:
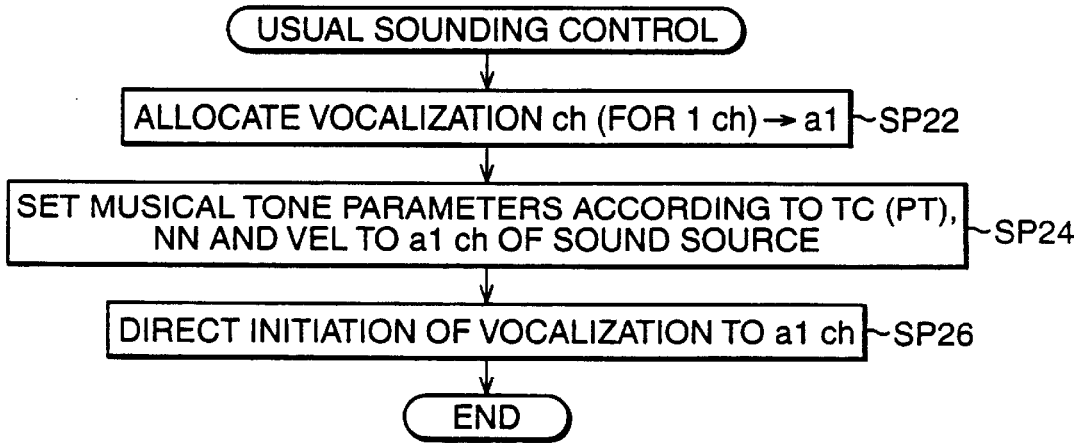

At first, when a note on event is generated, a note-on-event processing routine shown in FIG. 2(*a*) is activated.

When the processing advances to the step SP2 in the drawing, a part number substitutes for a variable PT; a note number, for a variable NN; and a velocity, for a variable VEL. Then, when the processing advances to the step SP4, determination is made as to a flag PLE is "1". It is to be noted that the flag PLE is a flag indicative of the on/off state of the pseudo low tone effect, and "1" indicates ON while "0" indicates OFF. Incidentally, a value of the flag PLE can be switched any time by performing a predetermined operation by a user.

If the flag PLE is "0", it is determined as "NO", and the processing proceeds to the step SP10. Here, an usual sounding control subroutine shown in FIG. 2(*b*) is called. When the processing advances to the step SP22 in the flowchart, one vocalization channel is allocated in the sound source in the sound board 10. A channel number of the allocated vocalization channel is determined as a1.

Subsequently, when the processing proceeds to the step SP24, musical tone parameters according to the timbre TC (PT) corresponding to the part number PT, the note number NN and the velocity VEL are set with respect to the channel number a1 in the sound source. Here, as the sound tone parameters, there are the following types.

(1) Address information of the usual musical tone waveform data (selected waveform data) corresponding to the note number NN among a plurality of sets of usual musical tone waveform data corresponding to the timbre TC (PT) stored in the waveform memory.

Since the usual musical tone waveform data 38 is constituted by the attack section and the loop section, their start and end addresses must be set. However, the usual musical tone waveform data 38 is constituted by only the loop section or only the one-shot waveform data depending on the timbre TC (PT) in some cases. Moreover, the waveform data which differ in accordance with each range of the velocity VEL may be applied in some cases.

(2) The F number corresponding to the note number NN.

With respect to the usual musical tone waveform data 38, an original pitch OP is set in accordance with each set of waveform data. When the note number NN is designated, a speed of advancing a read address of the usual musical tone waveform data 38, i.e., the F number is determined in accordance with a difference between the original pitch OP of the selected waveform data and the note number NN, and the sampling frequency of the waveform data.

(3) A sound volume envelope parameter.

When the timbre TC (PT), the velocity VEL and the note number NN are specified, a sound volume envelope parameter for specifying a sound volume envelope is determined in accordance with these members.

(4) Other parameters.

Besides, a tone filter parameter, a pitch modulation parameter, an amplitude modulation parameter and others corresponding to the timbre TC (PT), the note number NN and the velocity VEL are appropriately set.

Subsequently, when the processing proceeds to the step SP26, initiation of vocalization is commanded with respect to the channel number a1 of the sound source. Then, the processing for the note on event is completed. Thereafter, in the sound source of the sound board 10, the usual musical tone waveform data 38 is read at a speed corresponding to the note number NN, filtering processing according to the tone filter parameter and time-variable processing of the sound volume according to the sound volume envelope parameter are carried out, thereby sequentially generating the musical tone signal relating to the channel number a1 without including the pseudo low tone. Then, the musical tone signal is sounded through the sound system 12. Even if a frequency component not more than the lowest frequency is included in this musical tone signal, this component is not reproduced by the sound system 12, and a user cannot hear the sound of this component.

(2) When Pseudo low tone Effect is ON

If the note on event occurs while the pseudo low tone effect is in the ON state (flag PLE=1), the processing proceeds to the step SP6 through the steps SP2 and SP4. Here, determination is made as to the pseudo low tone waveform should be generated, namely, whether a periodic component in a low-tone range which is irreproducible in the sound system 12 exists on the timbre TC (PT) and the note number NN. Incidentally, even if the note number NN is specified, since its fundamental frequency may be deviated in units of octaves in some cases, the timbre TC (PT) is added to make determination.

For example, it is assumed that the reproducible lowest frequency is 120 Hz and the note number corresponds to the fundamental frequency as it stands (no deviation of octaves). Here, if a reference pitch is A4=440 Hz, there can be obtained A2=110 Hz, A#2=116.54 Hz and B2=123.471 Hz, and it can be hence understood that the pseudo low tone waveform should be generated when the pitch is not more than A#2.

Subsequently, when the processing advances to the step SP8, the processing branches in accordance with the result of determination in the step SP8. At first, when it is determined that "the pseudo low tone waveform should not be generated (note number is not less than B2)", the processing proceeds to the step SP10. As a result, the usual sounding control subroutine (FIG. 2(*b*)) is called as similar to the case where the pseudo low tone effect is in the off state. Therefore, the vocalization channel for one channel is allocated to the note on event, and the musical tone signal based on the usual musical tone waveform data 38 is sequentially produced in that vocalization channel.

Figure 8:
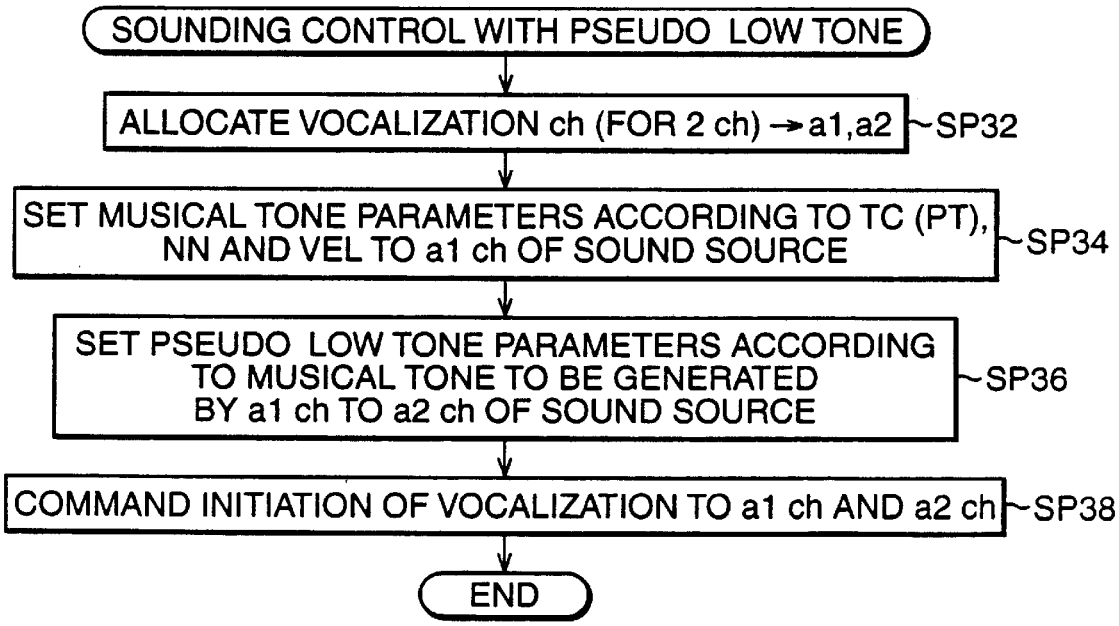
FIG. 8 is a flowchart of a sounding control routine with a pseudo low tone in the first embodiment.

On the other hand, if "YES" is determined in the step SP8, the processing advances to the step SP12. Here, the sounding control routine with the pseudo low tone shown in FIG. 8 is called. When the processing proceeds to the step SP32 in the flowchart, two vocalization channels are allocated in the sound source of the sound board 10. Channel numbers of the allocated vocalization channels are determined as a1 and a2.

Subsequently, when the processing advances to the step SP34, musical tone parameters according to the timbre TC (PT) corresponding to the part number PT, the note number NN and the velocity VEL are set with respect to the channel number a1 in the sound source. The detail of the processing is similar to that in the above-mentioned step SP24. Then, when the processing proceeds to the step SP36, pseudo low tone parameters are set to the channel number a2 in accordance with the musical tone signal produced in the channel number a1.

Here, as the musical tone parameters set for the pseudo low tone, there are the following types.

(1) Address information of the pseudo low tone waveform data 52 (selected pseudo low tone waveform data) corresponding to the usual musical tone waveform data 38 selected in the step SP34.

(2) An F number of the pseudo low tone waveform data corresponding to the note number NN.

The F number for the pseudo low tone waveform data 52 is determined by the procedure similar to that of the F number for the usual musical tone waveform data 38. That is, the F number of the pseudo low tone waveform data is determined in accordance with a difference between the original pitch OP of the pseudo low tone waveform data and the note number, and the sampling frequency of the pseudo low tone waveform data. Here, the original pitch OP of the pseudo low tone waveform data has the same value as the original pitch OP of the corresponding usual musical tone waveform data (waveform data reproduced by the channel number a1). Therefore, the F number of the pseudo low tone waveform data has a predetermined proportionality relation with respect to the F number of the usual musical tone waveform data (however, the sampling frequencies are different from each other). Consequently, in the channel number a2, it is possible to obtain a pseudo low tone having the pitch and the time axis completely synchronized with the musical tone signal generated by the channel number a1.

(3) A sound volume envelope of a pseudo low tone according to a sound volume envelope of the channel number a1.

As described in conjunction with FIG. 7, a sound volume envelope of a pseudo low tone (characteristic B) is different from a sound volume envelope of the original waveform (characteristic A). Therefore, the sound volume envelope of the channel number a1 is transformed to set a sound volume envelope for the pseudo low tone.

Figure 9:
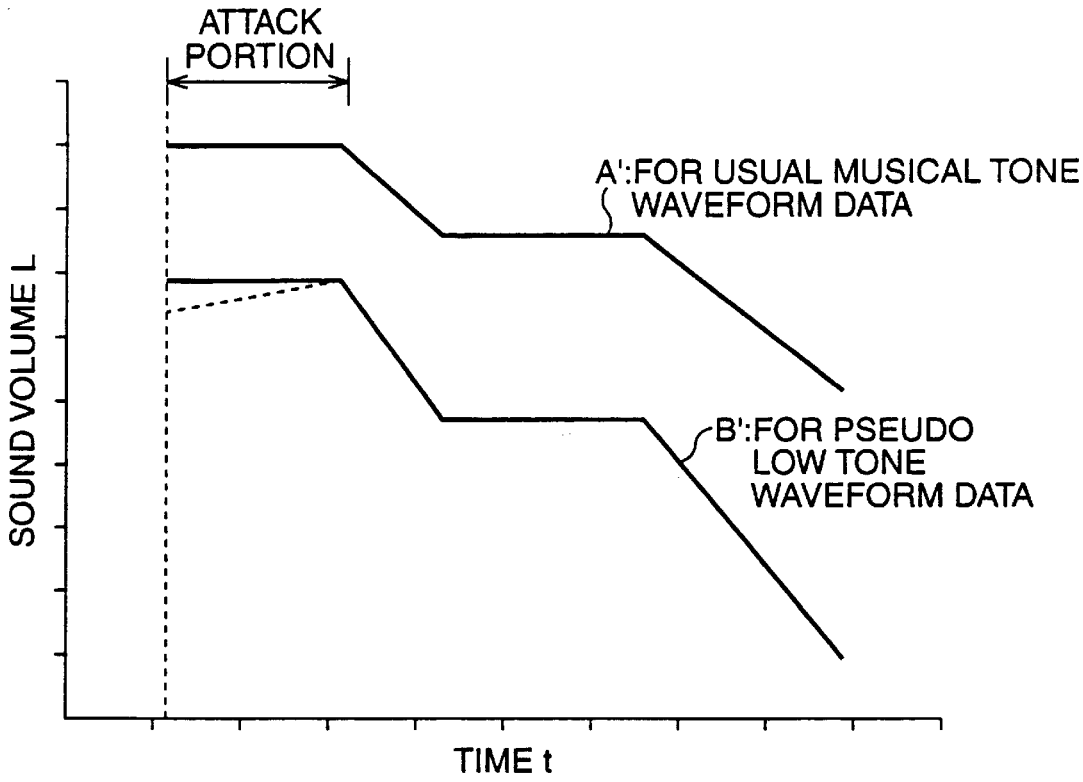
FIG. 9 is a view showing an example of a sound volume envelope in the first embodiment.

However, waveform data having the varying sound volume envelope is stored in the attack section each of the usual musical tone waveform data 38 and the pseudo low tone waveform data 52. Accordingly, in each channel of the waveform memory type sound source, a change in time of the sound volume does not have to be added to the attack section, and the sound volume envelope parameter for specifying a flat sound volume envelope of the attack section is set. FIG. 9 shows examples of the sound volume envelope for the usual musical tone waveform data 38 given by the channel number a1 (characteristic A') and the sound volume envelope for the pseudo low tone waveform data 52 given by the channel number a2 (characteristic B').

Each sound volume envelope conforms to the relationship of the equal loudness described in conjunction with FIG. 7, and it starts to change when the waveform data reproduced by each channel enters from the attack section to the loop section. In a flat portion, since the loudness of the frequency component not more than the lowest frequency included in the usual musical tone waveform data 38 to be reproduced is substantially matched with the loudness of the pseudo low tone waveform data, it is set that the level of the characteristic B' is lower than the level of the characteristic A'. Further, in the loop section, since the quantity of loudness change of the component not more than the lowest frequency included in the loop section of the usual musical tone waveform data to be reproduced is substantially matched with the quantity of loudness change of the loop section of the pseudo low tone waveform data, it is set that the inclination of the characteristic B' is steeper than that of the characteristic A'. As a result, in the channel number a2, it is possible to obtain the pseudo low tone waveform in which the loudness characteristic follows with respect to the component not more than the lowest frequency included in the musical tone signal produced by the channel number a1.

(4) Other parameters.

The contents of other various types of parameters are basically set as similar to those of the channel number a1.

Again referring to FIG. 8, when the processing advances to the step SP8, initiation of vocalization is commanded with respect to the channel numbers a1 and a2 in the sound source. Then, the processing relative to the note on even is completed. Thereafter, in the channel number a1 of the sound source in the sound board 10, the usual musical tone waveform data 38 is read out at a speed according to the note number NN, and the musical tone signal relating to the channel number a1 is sequentially produced without including the pseudo low tone. In synchronization with this, in the channel number a2, the pseudo low tone waveform data 52 according to the note number NN is read, and the pseudo low tone signal is sequentially generated. As a result, both the tome signals are sounded through the sound system 12. Although the components less than the lowest frequency or critical frequency in the musical tone signal is not reproduced in the sound system 12, a user can hear the pseudo low tone corresponding to the irreproducible component, and a user have an illusion as if this low tone component is reproduced.

As described above, according to this embodiment, since the sound volume envelope relating to the usual musical tone waveform and the sound volume envelope relating to the pseudo low tone waveform can be individually controlled, it is possible to control the sound volume level and the dynamic range in conformity to the equal loudness contour in accordance with respective situations.

2. Second Embodiment

A second embodiment according to the present invention will now be described. Although the hardware structure of the second embodiment is similar to that of the first embodiment, waveform data prepared for the waveform memory of the sound board 10 and a software structure for control are somewhat different from those of the first embodiment, and only differences will be explained.

(1) Waveform Data Generation Processing

Figure 4:
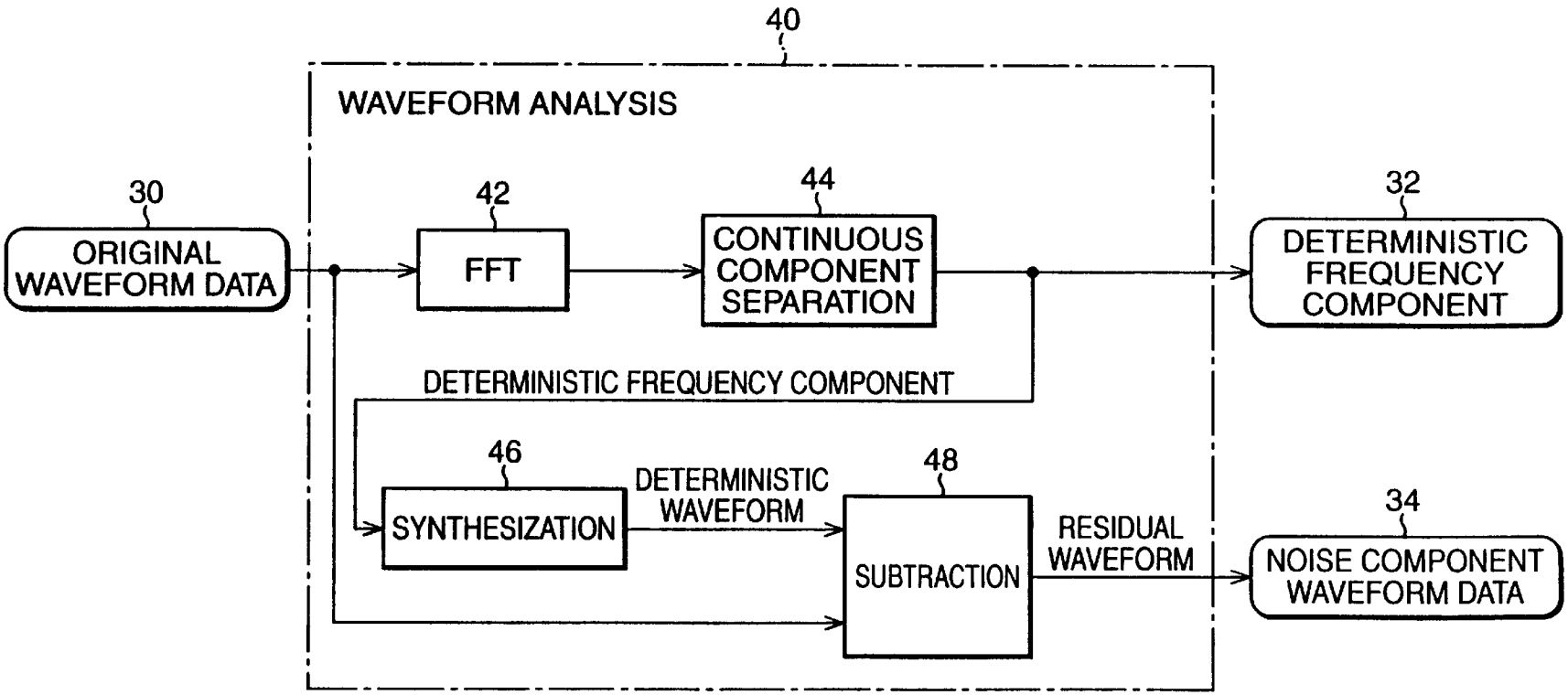
FIG. 4 is a block diagram showing details of waveform data analysis processing in the first embodiment.
Figure 10:
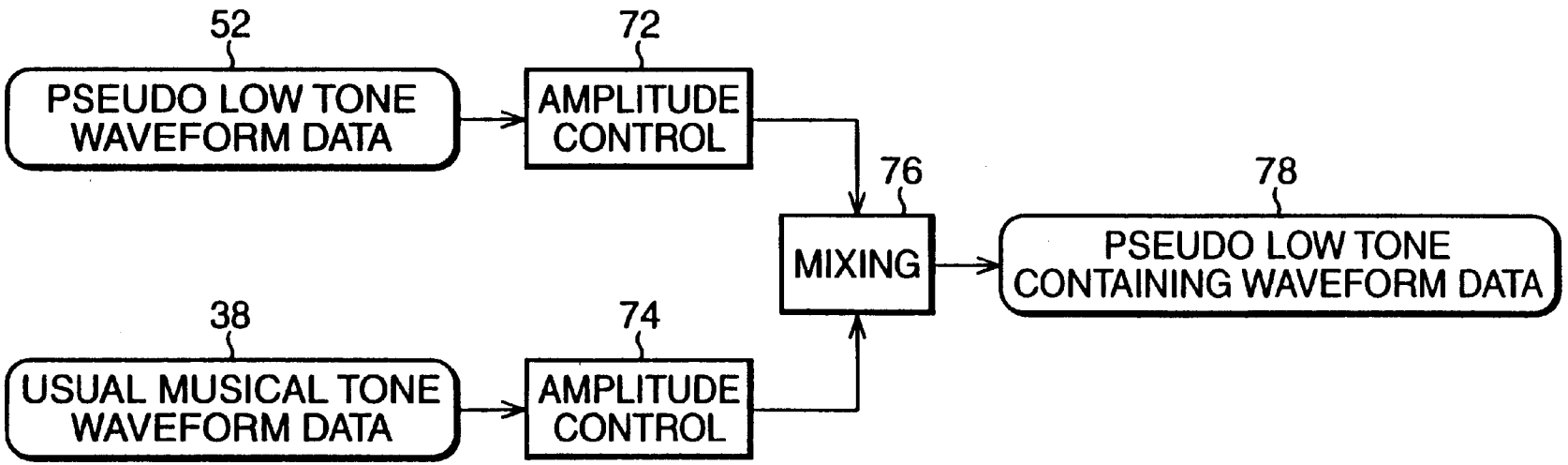
FIG. 10 is a block diagram showing a primary part of waveform data generation processing in a second embodiment.

In this embodiment, the waveform data generation processing similar to that described with reference to FIGS. 3 and 4 is executed, thereby obtaining the usual musical tone waveform data 38 and the pseudo low tone waveform data 52. Further, in this embodiment, the processing illustrated in FIG. 10 is executed.

In the drawing, reference numerals 72 and 74 denote amplitude control portions for controlling amplitudes of the waveform data 38 and 52. That is, the amplitudes of both sets of the waveform data are set in such a manner that a difference in level corresponding to a difference in the attack section between the characteristics A' and B' in FIG. 9 of the first embodiment is given to the envelopes of both sets of the waveform data. Reference numeral 76 designates a mixing portion for mixing both the waveform data subjected to the amplitude control and outputting its result as the waveform data 78 containing a pseudo low tone. These waveform data 38 and 78 are stored in the hard disk 2, and the waveform data 52 is deleted. As described above, the usual musical tone waveform data 38 is mixed with the pseudo low tone waveform data which is the pseudo low tone waveform data 52 corresponding to a frequency component not more than the lowest frequency included in the data 38 and subjected to the amplitude control so as to obtain the equal loudness with this frequency component, thereby preparing the waveform data 78 containing the pseudo low tone.

Here, in the method described in conjunction with FIG. 7, the sound pressure level is attenuated in order to adjust the loudness for the pseudo low tone, but the control of the degree of the change in the sound pressure level for uniforming the changes in the loudness is not executed. That is because a magnitude ratio of the change in the sound pressure level is close to 1 in "Robinson & Dodson", and it is hence judged that this control can be omitted. The generated usual musical tone waveform data 38 and the pseudo low tone inclusive waveform data 78 corresponding thereto are transferred to the waveform memory in the sound board 10 in accordance with a predetermined operation by a user. Although the usual musical tone waveform data 38 is stored in the waveform memory in the sound board 10 in accordance with each note range of the timbre, the pseudo low tone inclusive waveform data can be prepared for the usual musical tone waveform data 38 whose fundamental wave component is used for the musical tone generation with a pitch less than the lowest frequency, and stored in the waveform memory.

(2) Note-on-event Processing

Figure 11:
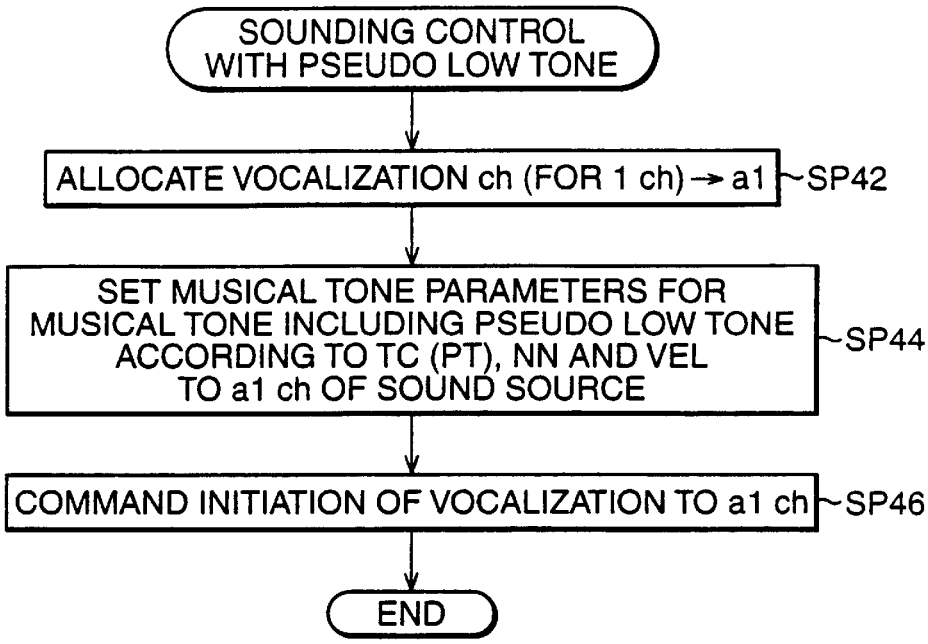
FIG. 11 is a flowchart of a sounding control routine with a pseudo low tone in the second embodiment.

In this embodiment, when a note on event occurs, the note-on-event processing routine shown in FIG. 2(*a*) is activated as similar to the first embodiment. The processing of the step SP10 executed when the pseudo low tone effect is in the off state or when the pseudo low tone effect is in the on state and an irreproducible frequency component in a low tone range does not exist in a musical tone signal to be produced is completely the same as that in the first embodiment. If the pseudo low tone effect is in the on state and an irreproducible frequency component in a low tone range is included in a musical tone signal to be generated, the sounding control routine with a pseudo low tone shown in FIG. 11 is called in place of the processing shown in FIG. 8 in the step S12.

The details of the steps SP42, SP44 and SP46 executed in this routine are similar to those of the steps SP22, SP24 and SP26 (FIG. 2(*b*)) respectively executed relative to the usual musical tone waveform. In the step SP44, however, the address information, the F number, the sound volume envelope parameter and other parameters with respect to the pseudo low tone inclusive waveform data 78 instead of the usual musical tone waveform data 38 are set in the sound source within the sound board 10. The address information to be set is address information of the pseudo low tone inclusive waveform data 78 corresponding to the usual musical tone waveform data 38 according to the note number NN among multiple sets of musical tone waveform data 38 corresponding to the timbre TC (PT) stored in the waveform memory. Basically, it is good enough that the F number, the sound volume envelope parameter and other parameters can have the same values as those of the corresponding parameters of the usual musical tone waveform data 38.

Consequently, in the step SP46, when initiation of vocalization is commanded to the channel number a1 of the sound source, the pseudo low tone inclusive waveform data 78 is read at a speed according to the note number NN in the sound source of the sound board 10, and the filtering processing according to the above-mentioned note filter parameter or the time-variable processing of the sound volume according to the sound volume envelope parameter is executed, thereby sequentially generating the musical tone signal relating to the channel number a1 with the pseudo low tone being included. Then, the musical tone signal is sounded through the sound system 12. Since this musical tone signal includes the pseudo low tone corresponding to a frequency component not more than the irreproducible lowest frequency, a user can hear the sound of this frequency component as if this component is reproduced.

According to this embodiment, even in case of generating a pseudo low tone, the vocalization channel allocated to one note-on-event can be restricted to one channel. Therefore, the present invention can be preferably used when restricting the increase in number of vocalization channels in particular.

3. Third Embodiment

A third embodiment according to the present invention will now be described. The hardware structure of the third embodiment is the same as that of the first embodiment except that the sound source of the sound board 10 is not a waveform memory type sound source but a frequency modulation type sound source (FM sound source). Although the software structure is somewhat different from that of the first embodiment, only differences will be described hereinafter.

(1) Waveform Data Generation Processing

In this embodiment, since the musical tone signal is produced by the FM sound source system, the waveform data generation processing such as that in the first and second embodiments is not executed.

(2) Usual Sounding control in Note-on-event Processing

In this embodiment, when a note on event occurs, the note-on-event processing routine shown in FIG. 2(*a*) is activated as similar to the first embodiment. However, in this embodiment, when a pseudo low tone should not be generated, the usual sounding control subroutine shown in FIG. 12(*a*) is called in the step SP10.

Figure 12A:
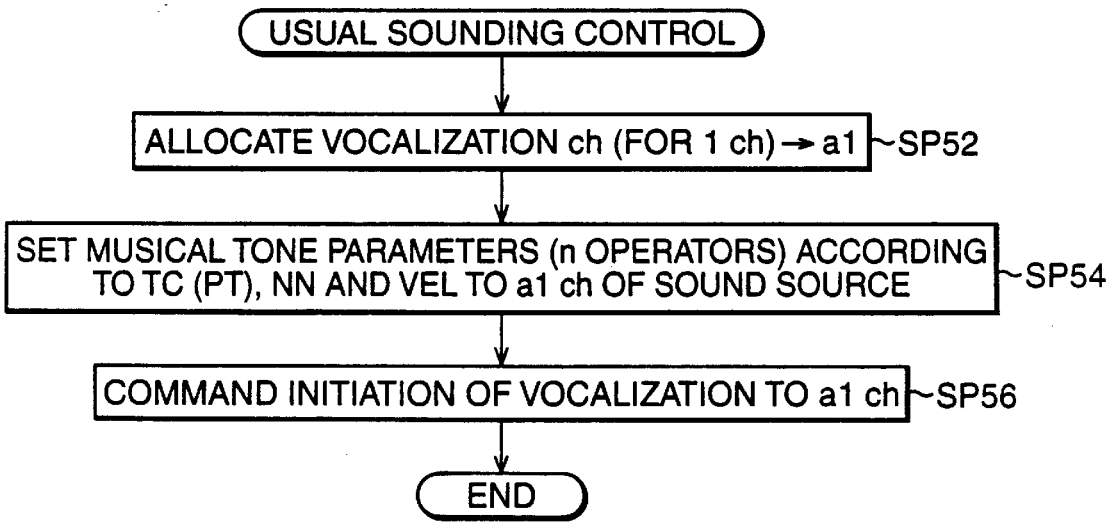
FIG. 12 is flowcharts of a control routine in third and fourth embodiments.
Figure 12B:
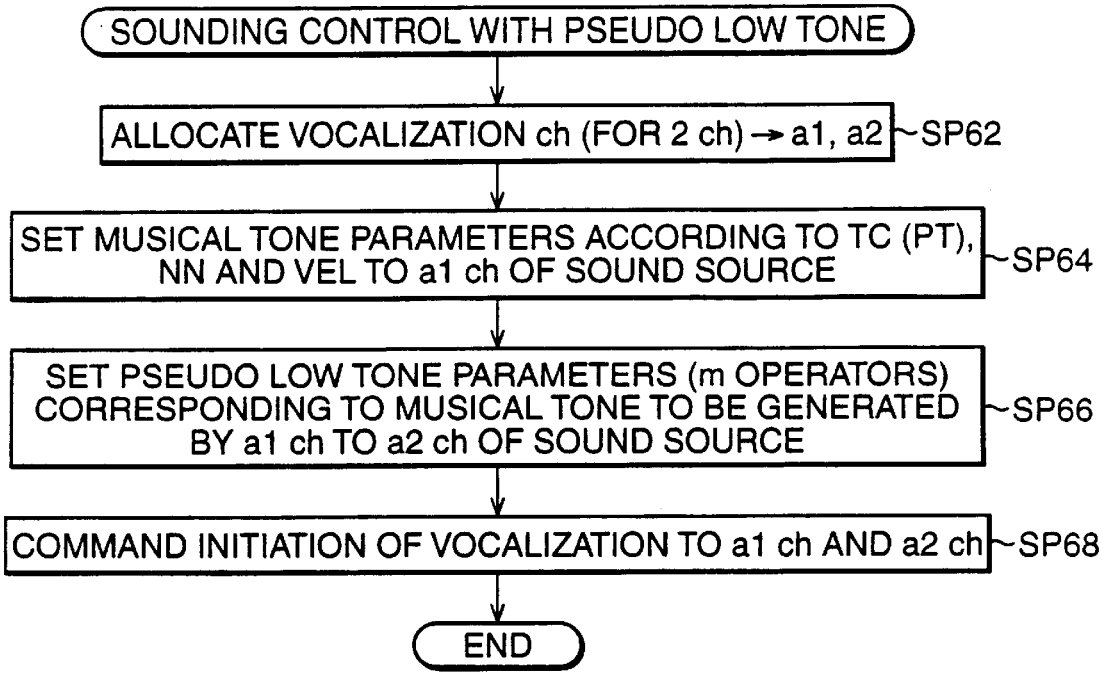
Figure 12C:
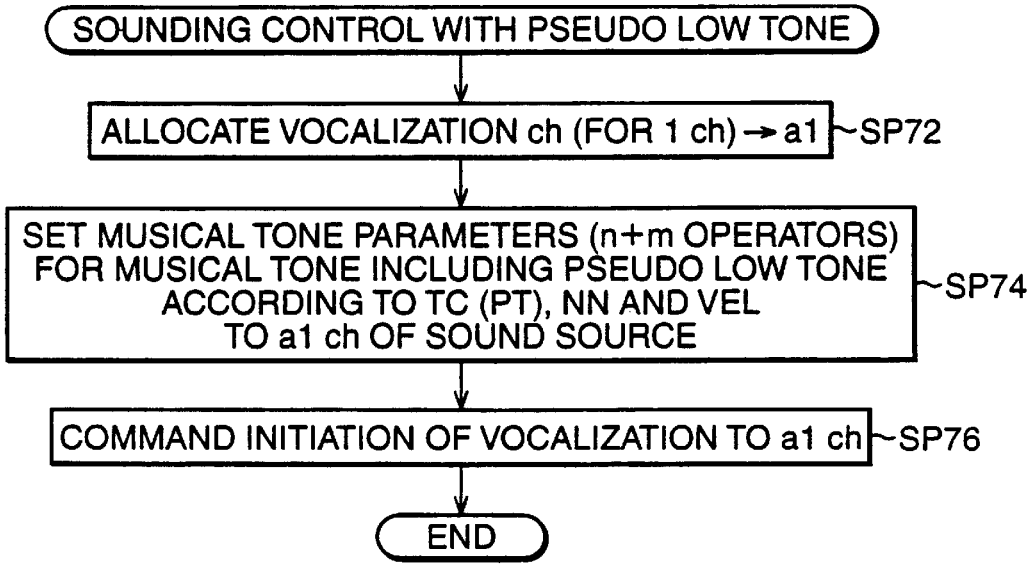

When the processing advances to the step SP52 in FIG. 12(*a*), one vocalization channel is allocated in the sound source of the sound board 10. The channel number of this allocated vocalization channel is determined as a1.

Subsequently, when the processing proceeds to the step SP54, the musical tone parameters for the musical tone signal according to the timbre TC (PT) corresponding to the part number PT, the note number NN and the velocity VEL are set with respect to the channel number a1 in the sound source. In general, the musical tone parameters of the FM sound source set to the sound source channel are prepared by adding correction (scaling) according to the note number NN and the velocity VEL with respect to the basic musical tone parameters for the musical tone signal based on the timbre data each set of which is prepared for each timbre TC. Here, as the musical tone parameters, there are the following types.

(1) Algorithm

Figure 13A:
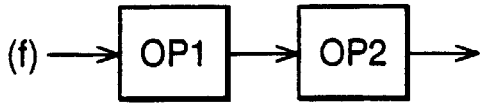
FIG. 13 is block diagrams of algorithms in the third and fourth embodiments.
Figure 13B:
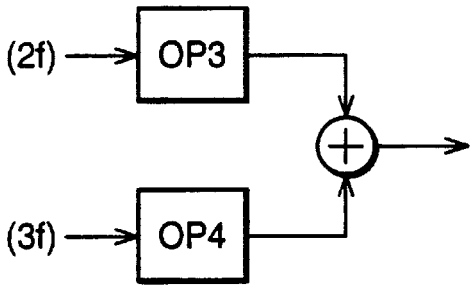
Figure 13C:
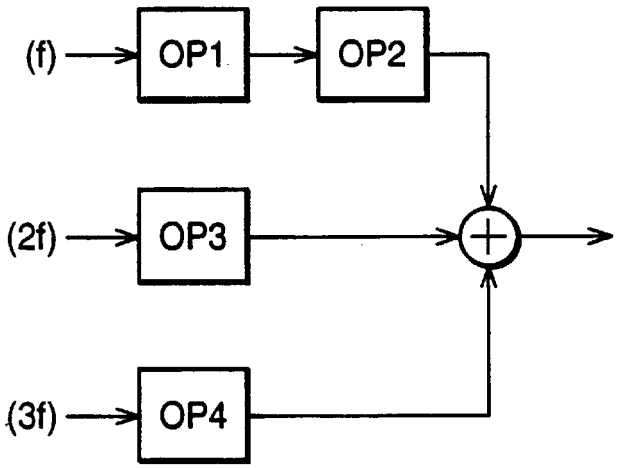

In the FM sound source system adopted in this embodiment, an algorithm (connection state of n units of operators) is selected in accordance with the timbre TC (PT). Further, there are determined types of waveform data used by each operator (the sine wave, the half-wave rectified waveform of the sine wave, the full-wave rectified waveform of the sine wave and others), pitch data for controlling a speed of advance of phase data for generating the waveform data (controlling the pitch of the waveform data), a multiplier factor relative to the pitch data for each operator (the speed of advance of the phase data in each operator is controlled by a product of the multiplier factor and the pitch data), low-frequency modulation control data (controlling tremolo and others), an envelope parameter for controlling the envelope waveform given to the waveform data generated by each operator, and others in accordance with the note number NN and the velocity VEL. As the contents of the algorithm, various kinds of contents can be considered. As a simple example, serial connection of "n=2" operators OP1 and OP2 such as shown in FIG. 13(*a*) can be considered.

(2) Sound Volume Envelope Parameter

The envelope given by an operator in the final stage of the algorithm (in the illustrative example, OP2) corresponds to the sound volume envelope of the musical tone signal outputted from the FM sound source. As described above, the envelope parameter of the envelope is determined in accordance with the timbre TC (PT), the note number NN and the velocity VEL.

(3) Other Parameters

In case of effecting the filtering processing with respect to an output of the algorithm, the tone filter parameter and others according to the timbre TC (PT), the note number NN and the velocity VEL are set. Furthermore, a pitch envelope parameter for controlling the pitch envelope for fluctuating the pitch of the musical tone signal to be produced may be set in some cases.

Subsequently, when the processing proceeds to the step SP56, initiation of vocalization is commanded to the channel number a1 of the sound source. Then, the processing of the note on event is completed. Thereafter, in the sound source of the sound board 10, the musical tone signal concerning the channel number a1 is sequentially generated without including a pseudo low tone. Furthermore, the musical tone signal is sounded through the sound system 12. Even if a frequency component not more than the lowest frequency is included in this musical tone signal, this component is not reproduced by the sound system 12, and a user cannot hear that component.

(3) Sounding control with Pseudo low tone in Note-on-event Processing

When the processing advances to the step SP12 in the note-on-event processing routine (FIG. 2(*a*)), the sounding control routine with a pseudo low tone shown in FIG. 12(*b*) is called. When the processing proceeds to the step SP62 in the flowchart, the two vocalization channels are allocated in the sound source of the sound board 10. The channel numbers of the allocated vocalization channels are determined as a1 and a2.

When the processing proceeds to the step SP 64, musical tone parameters for musical tone signals according to the timbre TC (PT) corresponding to the part number PT, the note number NN and the velocity VEL are set. The detail of the processing is similar to that in the above-described step SP54. Subsequently, when the processing advances to the step SP66, m units of operators for pseudo low tones are assured in the channel number a2 in accordance with the musical tone signals to be generated in the channel number a1, and their parameters are set.

Here, as the musical tone parameters set for the pseudo low tone, there are the following types.

(1) Algorithm

In order to generate a pseudo low tone, an algorithm (see FIG. 13(*b*)) having a structure in which two operators OP3 and OP4 are connected in parallel is set to the channel number a2.

A frequency component corresponding to the note number NN which is irreproducible by the sound system 12 is included in the frequency component of the musical tone signal to be generated in the channel number a1. Here, it is assumed that an operator having a multiplier factor of the pitch data being 1 among operators in the last stage of the channel number a1 generates the lowest tone. In this case, pitch data having a frequency f corresponding to the note number NN which is the same as that of the channel number a1 is set to the channel number a2, and each operator of the channel number a2 appropriately sets a multiplier factor, thereby generating a harmonic tone of that frequency f. In each operator, the pitch of the waveform data to be generated becomes greater than the lowest frequency, and combinations of a plurality of multiplier factors are set such that the greatest common factor becomes "1" (for example, "2, 3", "3, 4", . . . ). As a result, the pitch frequencies of the signals to be actually generated are, for example, "2f, 3f", "3f, 4f", . . . .

(2) Sound Volume Envelope Parameter

When the timbre TC (PT), the velocity VEL and the note number NN are specified, a sound volume envelope parameter is determined in order to specify a sound volume envelope given to the operator for the pseudo low tone (in the illustrative example, OP3 and OP4). The relationship of the sound volume envelope between the channel number a1 and a2 is similar to that in the first and second embodiments. That is, the envelope parameter of the sound volume envelop which has the equal loudness relation with the sound volume envelope for the irreproducible low-range component included in the musical tone signal generated by the channel a1 is set to each of the two operators of the channel number a2. Here, the envelope parameters set to the respective operators are different from each other in accordance with the pitch of the waveform data to be generated by each parameter.

(3) Other Parameters

Besides, a tone filter parameter and others corresponding to the note number NN and the velocity VEL are set. If the pitch envelope is set to the channel number a1, setting the same pitch envelope to the channel number a2 can cause the pitch for the pseudo low tone generated by the channel number a2 to follow fluctuations in the pitch of the musical tone signal generated by the channel number a1. Here, the above-described musical tone parameter for the pseudo low tone can be created by the method similar to the musical tone parameter for the musical tone signal. Specifically, the data for the pseudo low tone is first caused to be included in the tone data, each set of which is prepared for each timbre TC. Correction (scaling) according to the note number NN and the velocity VEL is then added to the basic musical tone parameter for the pseudo low tone included in the timbre data, thereby generating the musical tone parameter for the pseudo low tone.

Again referring to FIG. 12(*b*), when the processing proceeds to the step SP58, initiation of vocalization is commanded to the channel numbers a1 and a2 in the sound source. Then, the processing relative to the note-on-event is completed. Thereafter, the musical tone signal is sequentially generated without including the pseudo low tone in the channel number a1 of the sound source of the sound board 10. In synchronization with this, the pseudo low tone signal according to the note number NN is sequentially produced in the channel number a2. When both the signals are sounded through the sound system 12, despite the fact that a frequency component not more than the lowest frequency is not reproduced in the musical tone signal of the channel number a1, a user has an illusion as if that frequency component is heard by the pseudo low tone of the channel number a2.

4. Fourth Embodiment

A fourth embodiment according to the present invention will now be described. Although the hardware structure of the fourth embodiment is similar to that of the third embodiment, the software structure is somewhat different from that of the third embodiment, and description will be hence given as to only differences.

(1) Sounding control with Pseudo low tone in Note-on-event Processing

In this embodiment, when the processing proceeds to the step SP12 in the note-one-event processing routine (FIG. 2(*a*)), the sounding control routine with a pseudo low tone shown in FIG. 12(*c*) is called. When the processing advances to the step SP72 in the flowchart, one vocalization channel is allocated in the sound source within the sound board 10. The channel number a1 of the allocated vocalization channel is determined as a1.

Subsequently, when the processing proceeds to the step SP74, (m+n) units of operators are assured with respect to the channel number a1 in the sound source. Here, in this embodiment, it is assumed that an FM sound source capable of changing a number of operators for each channel is used. "m" and "n" mean numbers of operators for the usual vocalization and for the pseudo low tone in the above-mentioned third embodiment. Then, musical tone parameters according to the timbre TC (PT) corresponding to the part number PT, the note number NN and the velocity VEL are set to these operators.

The algorithm set herein equals to one obtained by connecting the algorithm for the usual vocalization with the algorithm for the pseudo low tone in the third embodiment in parallel. FIG. 13(*c*) shows one example thereof. The setting of other musical tone parameters is similar to that of the third embodiment.

Subsequently, when the processing proceeds to the step SP76, initiation of vocalization is commanded to the channel number a1 in the sound source. Then, the processing for the note-on-event is completed. Thereafter, the musical tone signal including the pseudo low tone is sequentially produced in the channel number a1 of the sound source in the sound board 10.

As described above, a difference between the third and fourth embodiments lies in that two vocalization channels are assured or one vocalization channel is assumed when effecting the sounding control with the pseudo low tone. A choice of either embodiment may be determined based on whether a maximum number of operators per one channel is not less than "n+m". In the example shown in FIG. 13, if the maximum number of operators is "3", the structure of the third embodiment (FIGS. 13 (*a*)+(*b*)) must be necessarily adopted. Further, if the maximum number of operators is not less than "4", any of the embodiments can be adopted, but it is advantageous to adopt the fourth embodiment because a number of channels can be restricted.

Modifications

The present invention is not restricted to the foregoing embodiments, and various modifications of the present invention are possible as follows.

(1) Although each of the above embodiments realizes the musical tone synthesis system by the software which is executed on a personal computer, the similar function may be used in various types of electronic instruments, mobile phones, amusement machines, and other devices which generate the musical tones. Furthermore, the software used in the above embodiments can be stored in a storage medium such as a CD-ROM or a floppy disk to be delivered, or can be delivered through a transmission path.

(2) In the above-described embodiments, a high pass filter for attenuating a frequency component not more than the lowest frequency which can be reproduced by the sound system may be provided between the sound board 10 and the sound system 12 so that the reproducible frequency component not more than the lowest frequency can be cut. As a result, the power consumption of an amplifier in the sound system 12 can be reduced.

(3) If the sound board 10 is a PCM sound source provided with a waveform RAM, the pseudo low tone waveform may be generated by analyzing the existing waveform data. At this time, a user may select or specify a reproducible lowest frequency, and the pseudo low tone waveform data may be automatically created based on the selected or specified lowest frequency.

(4) When applying the present invention to an electronic instrument, presetting of the pseudo low tone effect which matches with the sound system by a manufacturer is preferable if the present invention is incorporated in an electronic instrument provided with a sound system. In such a case, a plurality of types of setting may be prepared, and a user may select a preferable setting from them. On the other hand, in case of an electronic instrument provided with no sound system (for example, a synthesizer) or a sound board for a personal computer, it is impossible to provisionally specify the sound system. In this case, as similar to the foregoing embodiments, setting of the lowest frequency of the pseudo low tone effect, a quantity of attenuation, a quantity of amplitude compress and others may be executed by a personal computer on which a panel or a sound board of an electronic instrument is mounted.

(5) In the foregoing embodiments, as parameters for generating a pseudo low tone, there are used the lowest frequency or critical frequency, a quantity of attenuation (level L1 in FIG. 7), and a quantity of amplitude compress of a pseudo low tone (level ratio L3/L2 in FIG. 7). However, the quantity of attenuation and the quantity of amplitude compress may be determined as fixed parameters, and a pseudo low tone may be generated based on only the lowest frequency parameter. Alternatively, a pseudo low tone may be generated based on only the quantity of attenuation and the lowest frequency without taking changes in the amplitude compress in the pseudo low tone into consideration.

(6) In the above embodiments, if any of a plurality of sound systems is selectively switched to be used, the lowest frequency for each sound system may be previously stored, and the pseudo low tone effect may be automatically set in accordance with the switching situation of the sound system to be used.

(7) The control data for controlling the pseudo low tone (pseudo low tone control data) may be included in a part of timbre data for each timbre. Moreover, a plurality of sets of pseudo low tone control data corresponding to different lowest frequencies may be included in that timbre data. In such a case, when a user specifies a critical frequency of the sound system 12 in advance, the pseudo low tone control data which matches with that lowest frequency can be thereafter automatically selected to be used by simply effecting the operation for selecting a timbre.

(8) In the first and second embodiments using the waveform memory type sound source, although the processing for analyzing/creating the waveform data to be stored in the waveform memory is carried out, the processing for analyzing/creating the waveform data is not a must in the present invention. The analyzed/created waveform data (the usual musical tone waveform data 38 and the pseudo low tone waveform data 52) may be stored in the waveform memory in advance, and the stored waveform data may be used to carry out the present invention.

(9) In the third and fourth embodiments using the FM sound source, although the algorithm having two operators being connected in parallel for generating a pseudo low tone is used, any other algorithm may be used.

For example, in case of using an algorithm having two operators connected in series, it is good enough to set pitch data having the same pitch as that of a frequency of an irreproducible low-range component, generating waveform data with the same pitch as that of that frequency by the multiplier factor "1" in the operator on a modulator side, and generating the waveform data with the pitch which is twofold of that of the frequency by the multiplier factor "2" in the operator on a carrier side. Applying frequency modulation to the waveform data having the double pitch by using the waveform data having the same pitch can generate a frequency component of a side band at intervals of a frequency corresponding to the same pitch with the double pitch in the center. It is possible to produce the pseudo low tone by using a carrier component having the double pitch and a side band component higher than the former pitch (having a pitch which is three-fold of a frequency of a irreproducible low-range component).

In this case, a sound volume ratio of the carrier component and the side band component which is higher by one unit is determined by an output level of the operator on the modulator side. In order to facilitate the control, it is preferable to cause no time-fluctuation of the envelope of the operator on the modulator side, i.e., determine the sound volume ratio as a fixed value.

Moreover, as to the envelope of the operator on the carrier side, it is good enough to set the envelope parameter so that changes with time can occur while maintaining the relation of the sound volume of the irreproducible low-range component and the equal loudness.

(10) In the above-described embodiments, although the pseudo low tone is generated by the waveform memory type sound source or the FM type sound source, types of the sound source are not restricted to these two types. For example, in case of a sound source adopting the harmonic synthesis system or the partial sound synthesis system, one or more operators among a plurality of oscillators for each channel can be used to produce the pseudo low tone. In case of a sound source adopting a ring modulation system, a overtone generated by the ring modulation of the two oscillator systems can be used as the pseudo low tone. In case of a sound source capable of effecting non-linear conversion of the waveform data, the pseudo low tone can be produced based on the overtone generated by the non-linear conversion. Besides, the present invention may be applied to a physical model sound source or an analog modeling sound source.

(11) In the foregoing embodiments, although the pseudo low tone effect can be turned on/off, it may be set so as to be constantly in the on state.

(12) Although the lowest frequency is set by a user in the above-described embodiments, data representing individual lowest frequencies of a plurality of sound systems can be stored. By only selecting a sound system to be used, the lowest frequency can be automatically determined, and the pseudo low tone effect corresponding to the lowest frequency can be automatically set.

As described above, according to the present invention, since the first and second waveform signal are generated by making determination as to a specified pitch is not more than a predetermined critical pitch in connection with an electo-acoustic converter, it is possible to reduce a necessary quantity of arithmetic operation while generating the pseudo low tone.

5. Fifth Embodiment

5.1. Principle of Embodiment

In the above-described first to fourth embodiments, whether or not a pseudo low tone is to be generated is determined based on whether a pitch of a musical tone signal is not more than a predetermined critical frequency (for example, a cut-off frequency). According to this technique, however, the tone quality may slightly differ in the vicinity of the critical frequency, thereby resulting in somewhat irregular sensation. In view of this, it is an object of the fifth embodiment to provide an audio signal generation method capable of generating a pseudo low tone in a natural state.

5.2. Hardware Structure of Embodiment

Figure 14:
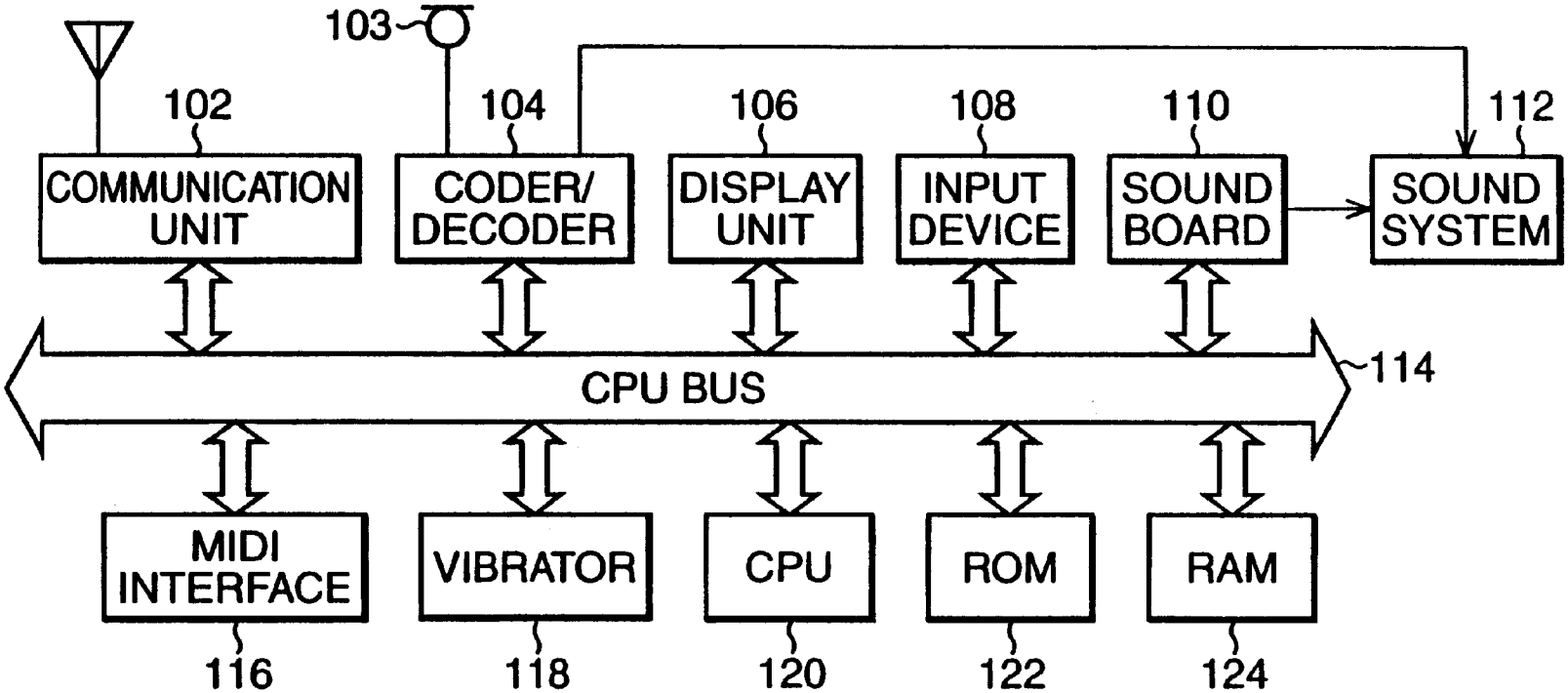
FIG. 14 is a hardware block diagram of a musical tone synthesis system of a fifth embodiment according to the present invention.

A hardware structure of a portable phone according to the fifth embodiment of the present invention will now be described with reference to FIG. 14. In the drawing, reference numeral 102 denotes a communication unit for carrying out wireless communication with a non-illustrated base station. Reference numeral 104 designates a coder/decoder for coding and decoding a signal transmitted/received in the communication unit 102. Reference numeral 103 represents a microphone for detecting a voice of a user. Reference numeral 106 denotes a display device for displaying various kinds of information to a user. Reference numeral 108 designates an input device which is constituted by a ten-key keyboard, command buttons and others, and to which various kinds of information is inputted by a user. Reference numeral 110 represents a sound source for generating a musical tone signal such as a ringing tone based on supplied performance information. In this embodiment, the sound source 110 is constituted by a waveform memory type sound source. The generated musical tone signal is sounded through a sound system 112. It is to be noted that the sound system 112 is constituted by an amplifier and an electo-acoustic converter. As the electo-acoustic converter, a speaker, a headphone, an earphone and others can be selected, and they have different conversion characteristics.

Reference numeral 116 denotes a MIDI interface for transmitting/receiving a MIDI signal to/from an external MIDI device. Reference numeral 118 designates a vibrator for vibrating the portable phone when the portable phone is set in a silent mode. Reference numeral 120 represents a CPU for controlling each part of the portable phone through a bus 114 based on a later-described control program. Reference numeral 122 denotes a ROM for storing therein an operating system, a musical tone synthesis program, performance information previously arranged in the portable phone, and other various kinds of data. Reference numeral 124 designates a RAM, which is used as a work memory of the CPU 120 and can also store therein performance information defined by a user. Furthermore, a waveform memory in the sound source 110 is backed up by a battery so that waveform data of a timbre defined by a user and other data can be stored.

5.3. Operation of Embodiment

5.3.1. Waveform Data Generation Processing.

Figure 15:
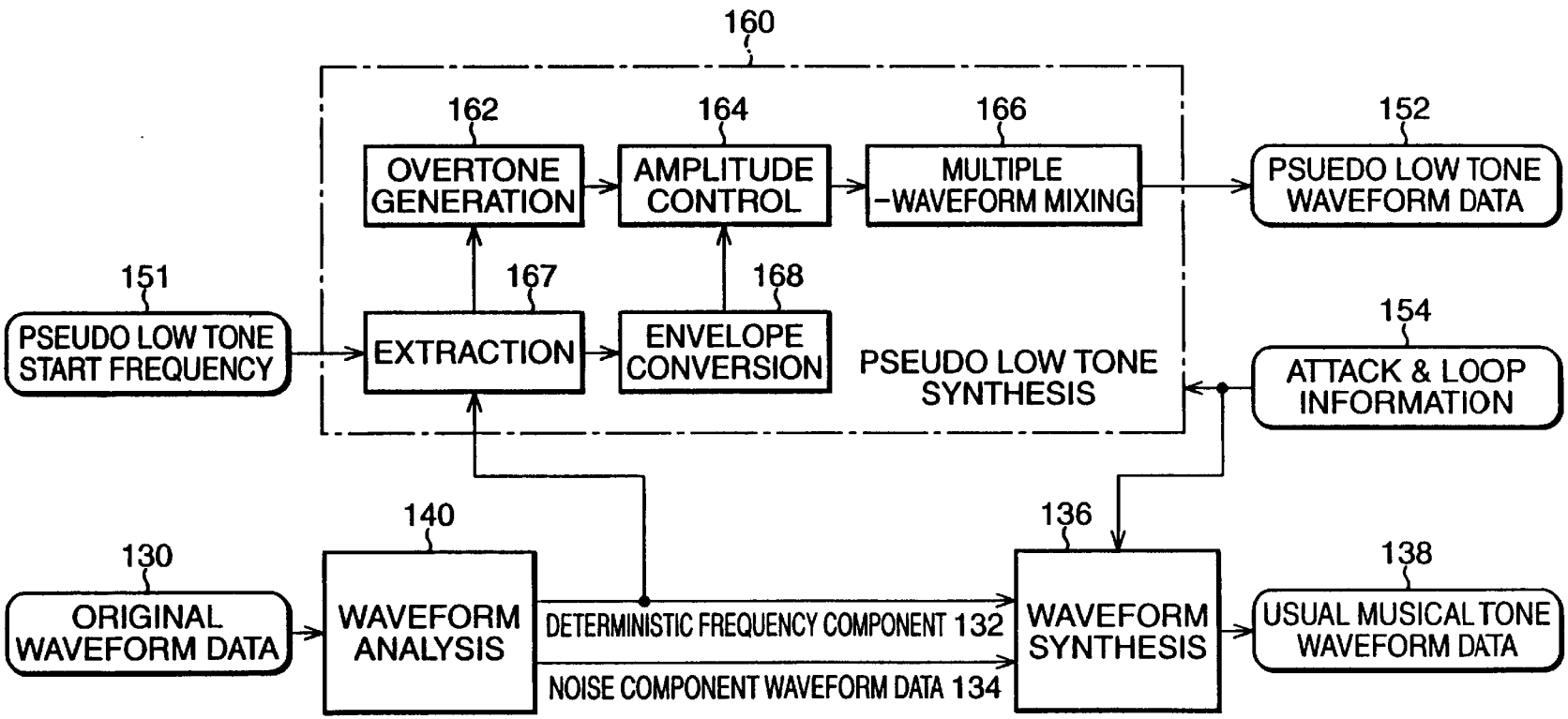
FIG. 15 is a block diagram showing details of waveform data generation processing in the fifth embodiment.

The waveform data used in this embodiment can be created by a manufacturer of portable phones or a user by using a personal computer. The detail of that processing will now be described with reference to FIG. 15. It is to be noted that FIG. 15 is a functional block diagram showing the contents of the processing program executed in the personal computer.

In the drawing, reference numeral 130 denotes original waveform data such as a recorded waveform of a musical tone of a natural instrument, and this data is externally inputted through the sound board, the removable disk, or the network. Reference numeral 140 designates a waveform analysis portion for classifying frequency components of the original waveform data 130 into a component continuous on the time axis (deterministic frequency component) and other fragmentary components (noise components). Here, the waveform analysis portion 140 has the same structure as that shown in FIG. 4. Further details of the waveform analysis portion 140 are described in FIG. 4.

Again referring to FIG. 15, reference numeral 154 denotes attack & loop information which is set while referring to the original waveform data 130 by a user. Alternatively, this information may be automatically set by using a result of the waveform analysis and the like in accordance with designation by a user. The content of the attack & loop information includes a length of an attack section which is read only once at the beginning of waveform reproduction, a length of a loop section which is repeatedly read after the length of the attach section. Reference numeral 136 designates a waveform synthesis portion for synthesizing waveform data of the attack section and the loop section based on the deterministic frequency component 132, the noise component waveform data 134, and the attack & loop information 154. The synthesized waveform data is usually stored as musical tone waveform data 138 in the hard disk and the like of the personal computer.

Here, the outline of the synthesis processing in the waveform synthesis portion 136 will be described. The attack & loop information 154 is first used to determine an attack start address indicative of a top of the attack section, and a loop start address and a loop end address indicative of a top and an end of the loop section. Subsequently, from the deterministic frequency components of the loop section, a component having a value close to the loop start phase at the loop end is selected. The selected component is corrected in such a manner that the phase at the loop end is matched with the phase at the loop start. Incidentally, if the loop is a long loop (loop size which is not less than several hundred milliseconds), a component having a value which is not close to the loop start phase at the loop end (non-overtone component) may be also selected and corrected. Then, sine wave synthesis is carried out based on the corrected frequency component, and the waveform data of the loop section is generated.

A component which has not been used for the loop section among the deterministic frequency components of the attack section is then processed in such a manner that this component gradually fades out from the middle of the attack section to the end of the attack section, and the sine wave synthesis is executed based on the processed deterministic frequency component, thereby generating the waveform data of the attack section. Further, a sound volume of the noise component waveform data 134 is controlled meanwhile, and mixed in the attack section and the loop section. The thus created waveform data of the attack section and the loop section has a waveform which is very similar to that of the original waveform data 130, and has good connections from the attack section to the loop section and from the loop end to the loop start.

Furthermore, reference numeral 160 denotes a pseudo low tone synthesis portion for generating pseudo low tone waveform data 152 based on pseudo low tone start frequency data 151 indicative of a highest frequency by which a pseudo low tone should be reproduced in a portable phone, the deterministic frequency component 132 and the attack & loop information 154. The pseudo low tone start frequency data 151 may be a frequency which is preset in accordance with a model of the portable phone (or models of a headphone, an earphone and others) or may be a frequency which can be optimally set by a user. Here, an example of a method for determining the pseudo low tone start frequency data 151 will be described with reference to FIG. 16. In the drawing, a horizontal axis represents a frequency or a note number NN, and a cut-off frequency (lowest or critical frequency) is determined in accordance with a characteristic of an electo-acoustic converter of the portable phone.

As described above, upon determining whether a pseudo low tone is to be generated with the cut-off frequency as the critical point, there occurs a problem that the sound quality greatly differs in the vicinity of the cut-off frequency. Thus, in the present embodiment, a pseudo low tone is generated even at a frequency higher than the cut-off frequency, and the level of the pseudo low tone is gradually increased as the frequency lowers, thereby easing the unpleasant sensation. Specifically, the sound volume coefficient RVOL which increases as the frequency lowers is determined in a range of "0 to 1" as shown in the drawing, and the sound volume coefficient RVOL is multiplied with the pseudo low tone waveform, thus realizing the above-mentioned fading process. A crossing point of the characteristic curve of the sound volume coefficient RVOL with the horizontal axis is referred to as a "pseudo low tone start frequency".

Again referring to FIG. 15, reference numeral 167 represents an extraction portion in the pseudo low tone synthesis portion 160 for extracting a frequency component not more than the pseudo low tone start frequency from the deterministic frequency components 132. Reference numeral 162 denotes a overtone generation portion for generating a plurality of overtone components above lowest frequency with respect to each extracted frequency component. Here, a frequency of the extracted frequency component fluctuates in time, and a frequency of the generated overtone component also fluctuates in accordance with that fluctuation.

For example, it is assumed that 240 Hz which is higher than the cut-off frequency (120 Hz) by one octave is set as the pseudo low tone start frequency. In this case, overtone component which is at least twofold and threefold of the frequency component of $120<f\leqq 240$ Hz in the deterministic frequency components is generated with respect to that frequency component. Similarly, at least the threefold and fourfold harmonic wave components are generated with respect to the frequency component of $80<f\leqq 120$ Hz, and at least the fourfold and fivefold harmonic wave components are produced with respect to the frequency component of $60<f\leqq 80$ Hz.

Reference numeral 168 denotes an envelope conversion portion for outputting an envelope of each overtone component in such a manner that the sound volume (loudness) of the pseudo low tone generated by each overtone component matches with the subjective sound volume of the original frequency component. Its content has been described already with reference to FIG. 7.

Again referring to FIG. 15, reference numeral 164 designates an amplitude control portion for multiplying each overtone component outputted from the overtone generation portion 162 by an envelope level outputted from the envelope conversion portion 168. Reference numeral 166 represents a multiple-waveform mixing portion for mixing each overtone component to which the envelope has been applied. A result of this mixing is stored as the pseudo low tone waveform data 152 in the hard disk of the personal computer. The usual musical tone waveform data 138 generated in the above-described manner and the corresponding pseudo low tone waveform data 152 are transferred to a waveform memory in the sound source 110 as waveform data of a music tone defined by a user when the user performs a predetermined operation.

5.3.2. Waveform Synthesis Processing

Performance information (for example, an SMF (standard MIDI format) file) for reproducing a ringing sound signaling an incoming call is stored in the ROM 122 or the RAM 124 in the portable phone. When the portable phone receives an incoming call, the music performance information is reproduced, and MIDI events are sequentially inputted from the CPU 120 to the sound source 110. A musical tone waveform is synthesized in the sound source 110 based on this input. The detail of this sound source control processing will now be described with reference to FIG. 17.

(1) When Pseudo low tone Effect is OFF

Figure 17A:
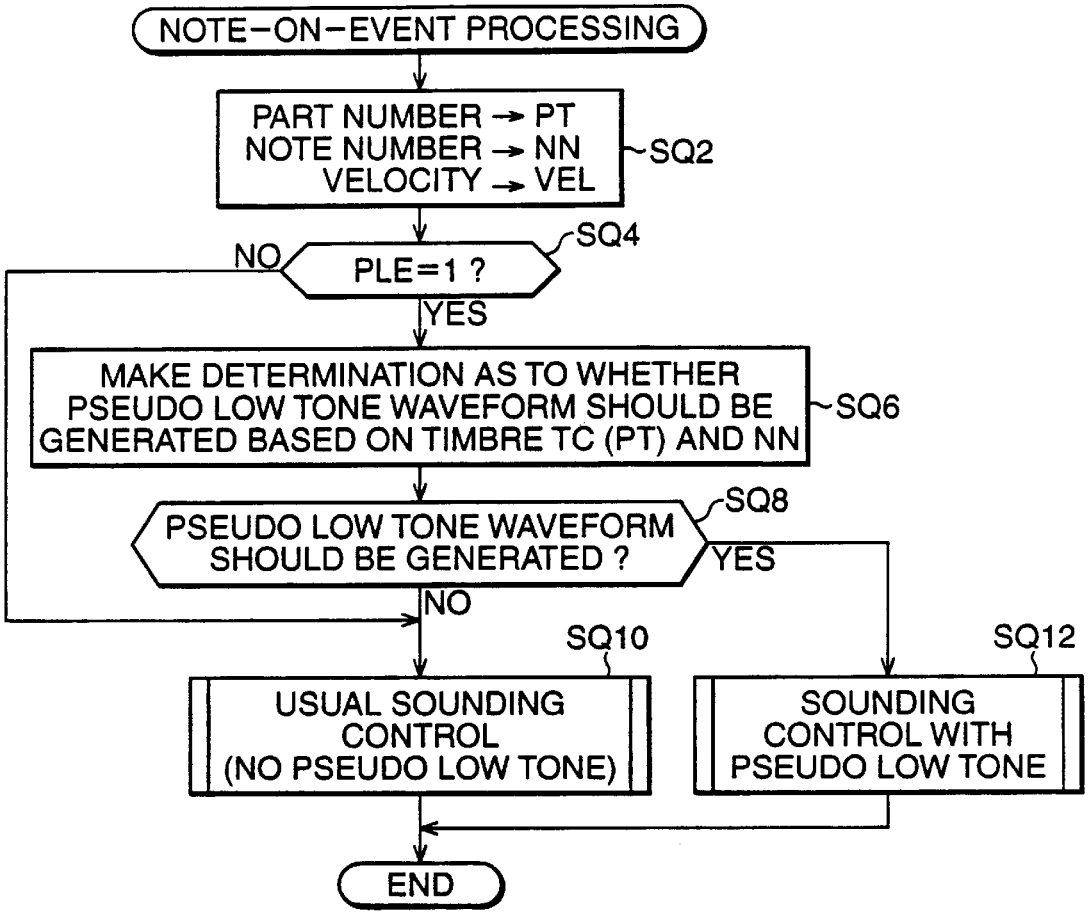
FIG. 17 shows flowcharts of a note-on-event processing routine and a usual sounding control subroutine.
Figure 17B:
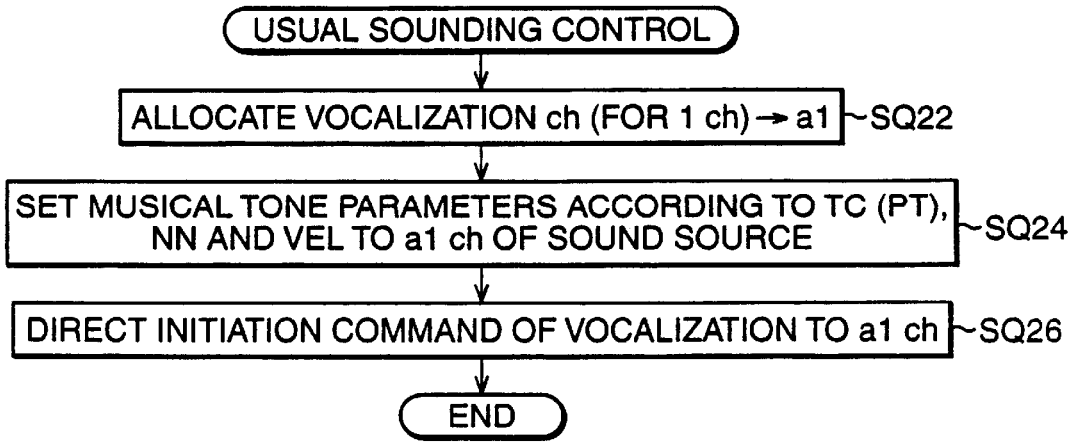

At first, when a note on event is generated, a note-on-event processing routine shown in FIG. 17(*a*) is activated.

When the processing advances to the step SQ2 in the drawing, a part number substitutes for a variable PT; a note number, for a variable NN; and a velocity, for a variable VEL. Then, when the processing advances to the step SQ4, determination is made as to a flag PLE is "1". It is to be noted that the flag PLE is a flag indicative of the on/off state of the pseudo low tone effect, and "1" indicates ON while "0" indicates OFF. Incidentally, a value of the flag PLE can be switched any time by performing a predetermined operation by a user.

If the flag PLE is "0", it is determined as "NO", and the processing proceeds to the step SQ10. Here, an usual sounding control subroutine shown in FIG. 17(*b*) is called. When the processing advances to the step SQ22 in the flowchart, one vocalization channel is allocated in the sound source in the sound source 110. A channel number of the allocated vocalization channel is determined as a1.

Subsequently, when the processing proceeds to the step SQ24, musical tone parameters according to the timbre TC (PT) corresponding to the part number PT, the note number NN and the velocity VEL are set with respect to the channel number a1 in the sound source. Here, as the sound tone parameters, there are the following types.

(1) Address information of the usual musical tone waveform data 138(selected waveform data) corresponding to the note number NN among a plurality of sets of usual musical tone waveform data 138 corresponding to the timbre TC (PT) stored in the waveform memory.

Since the usual musical tone waveform data 138 is constituted by the attack section and the loop section, their start and end addresses must be set. However, the usual musical tone waveform data 138 is constituted by only the loop section or only the one-shot waveform data depending on the timbre TC (PT) in some cases. Moreover, the waveform data which differ in accordance with each range of the velocity VEL may be applied in some cases.

(2) The F number corresponding to the note number NN.

With respect to the usual musical tone waveform data 138, an original pitch OP is set in accordance with each set of waveform data. When the note number NN is designated, a speed of advancing a read address of the usual musical tone waveform data 138, i.e., the F number is determined in accordance with a difference between the original pitch OP of the selected waveform data and the note number NN, and the sampling frequency of the waveform data.

(3) A sound volume envelope parameter.

When the timbre TC (PT), the velocity VEL and the note number NN are specified, a sound volume envelope parameter for specifying a sound volume envelope is determined in accordance with these members.

(4) Other parameters.

Besides, a tone filter parameter, a pitch modulation parameter, an amplitude modulation parameter and others corresponding to the timbre TC (PT), the note number NN and the velocity VEL are appropriately set.

Subsequently, when the processing proceeds to the step SQ26, initiation of vocalization is commanded with respect to the channel number a1 of the sound source. Then, the processing for the note on event is completed. Thereafter, in the sound source 110, the usual musical tone waveform data 138 is read at a speed corresponding to the note number NN, filtering processing according to the tone filter parameter and time-variable processing of the sound volume according to the sound volume envelope parameter are carried out, thereby sequentially generating the musical tone signal relating to the channel number a1 without including the pseudo low tone. Then, the musical tone signal is sounded through the sound system 112. Even if a frequency component not more than the lowest frequency is included in this musical tone signal, this component is not reproduced by the sound system 112, and a user cannot hear the sound of this component.

(2) When Pseudo low tone Effect is ON

If the note on event occurs while the pseudo low tone effect is in the ON state (flag PLE=1), the processing proceeds to the step SQ6 through the steps SQ2 and SQ4. Here, determination is made as to the pseudo low tone waveform should be generated, namely, whether a periodic component less than the pseudo low tone start frequency exists, based on on the timbre TC (PT) and the note number NN. Incidentally, even if the note number NN is specified, since its fundamental frequency may be deviated in units of octaves in some cases, the timbre TC (PT) is added to make determination.

For example, it is assumed that the cut-off frequency is 120 Hz, the pseudo low tone start frequency is 240 Hz and the note number corresponds to the fundamental frequency as it stands (no deviation of octaves). Here, if a reference pitch is A4=440 Hz, there can be obtained A3=220 Hz, A#3=233.08 Hz and B3=246.92 Hz, and it can be hence understood that the pseudo low tone waveform should be generated when the pitch is not more than A#3.

Subsequently, when the processing proceeds to the step SQ8, the processing branches in accordance with a result of determination in the step SQ6. At first, when it is determined that "the pseudo low tone waveform should not be generated (note number is not less than B3)", the processing proceeds to the step SQ10. As a result, the usual sounding control subroutine (FIG. 17(*b*)) is called as similar to the case where the pseudo low tone effect is in the off state. Therefore, one vocalization channel is allocated to the note on event, and the musical tone signal based on the usual musical tone waveform data 138 is sequentially produced in that vocalization channel.

Figure 16:
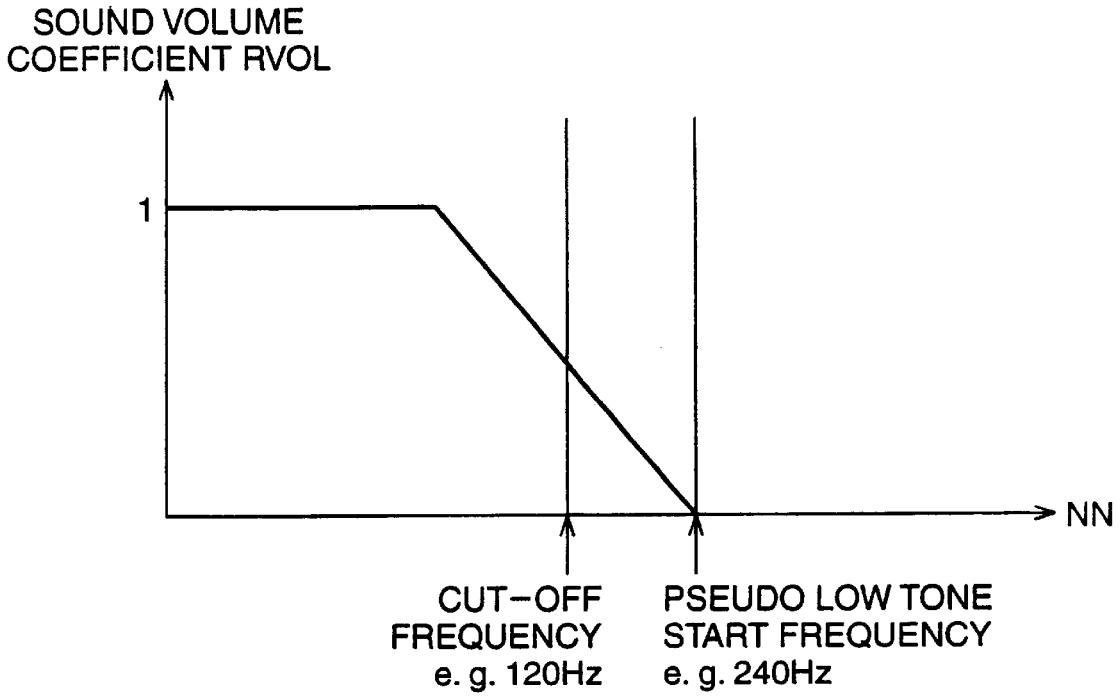
FIG. 16 is a diagram showing tone volume coefficient characteristics of the embodiments.
Figure 18:
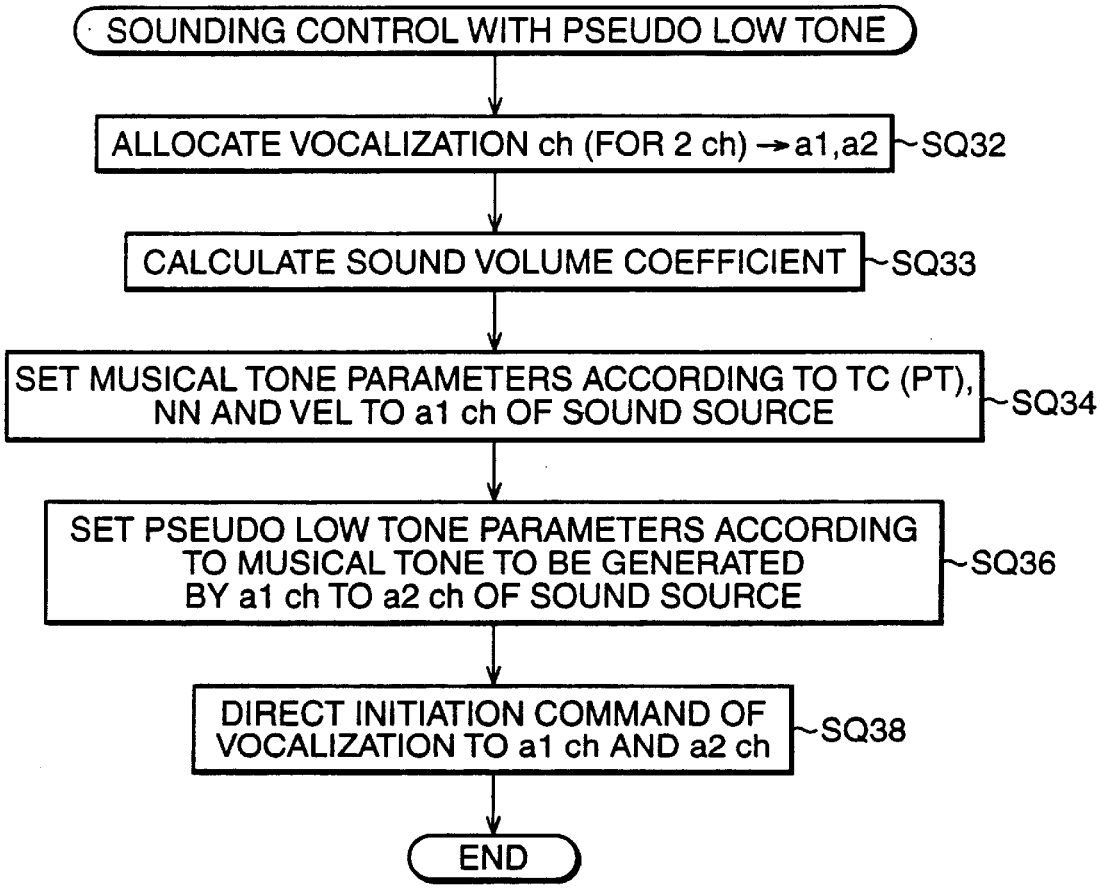
FIG. 18 is a flowchart of a sounding control routine with a pseudo low tone in the fifth embodiment.

On the other hand, in the step SQ8, if "YES" is determined in the step SQ8, the processing advances to the step SQ12. Here, the sounding control routine with the pseudo low tone shown in FIG. 18 is called. When the processing proceeds to the step SQ32 in the flowchart, two vocalization channels are allocated in the sound source 110. Channel numbers of the allocated vocalization channels are determined as a1 and a2. Then, when the processing advances to the step SQ33, the sound volume coefficient RVOL is determined based on the note number NN, the timbre TC (PT) and the sound volume coefficient characteristic (FIG. 16).

Subsequently, when the processing advances to the step SQ34, musical tone parameters according to the timbre TC (PT) corresponding to the part number PT, the note number NN and the velocity VEL are set with respect to the channel number a1 in the sound source. The detail of the processing is similar to that in the above-mentioned step SQ24. Then, when the processing proceeds to the step SQ36, pseudo low tone parameters are set to the channel number a2 in accordance with the musical tone signal produced in the channel number a1.

Here, as the musical tone parameters set for the pseudo low tone, there are the following types.

(1) Address information of the pseudo low tone waveform data 152 (selected pseudo low tone waveform data) corresponding to the usual musical tone waveform data 138 selected in the step SQ34.

(2) An F number of the pseudo low tone waveform data corresponding to the note number NN.

The F number for the pseudo low tone waveform data 152 is determined by the procedure similar to that of the F number for the usual musical tone waveform data 138. That is, the F number of the pseudo low tone waveform data is determined in accordance with a difference between the original pitch OP of the pseudo low tone waveform data and the note number, and the sampling frequency of the pseudo low tone waveform data. Here, the original pitch OP of the pseudo low tone waveform data has the same value as the original pitch OP of the corresponding usual musical tone waveform data (waveform data reproduced by the channel number a1). Therefore, the F number of the pseudo low tone waveform data has a predetermined proportionality relation with respect to the F number of the usual musical tone waveform data (however, the sampling frequencies are different from each other). Consequently, in the channel number a2, it is possible to obtain a pseudo low tone having the pitch and the time axis completely synchronized with the musical tone signal generated by the channel number a1.

(3) A sound volume envelope of a pseudo low tone according to a sound volume envelope of the channel number a1.

As described in conjunction with FIG. 7, a sound volume envelope of a pseudo low tone (characteristic B) is different from a sound volume envelope of the original waveform (characteristic A). Therefore, the sound volume envelope of the channel number a1 is transformed to set a sound volume envelope for the pseudo low tone.

However, waveform data having the varying sound volume envelope is stored in the attack section each of the usual musical tone waveform data 138 and the pseudo low tone waveform data 152. Accordingly, in each channel of the waveform memory type sound source, a change in time of the sound volume does not have to be added to the attack section, and the sound volume envelope parameter for specifying a flat sound volume envelope of the attack section is set. As described before, FIG. 9 shows examples of the sound volume envelope for the usual musical tone waveform data 138 given by the channel number a1 (characteristic A') and the sound volume envelope for the pseudo low tone waveform data 152 given by the channel number a2 (characteristic B').

Each sound volume envelope conforms to the relationship of the equal loudness described in conjunction with FIG. 7, and it starts to change when the waveform data reproduced by each channel enters from the attack section to the loop section. In a flat portion, since the loudness of the frequency component not more than the lowest frequency included in the usual musical tone waveform data 138 to be reproduced is substantially matched with the loudness of the pseudo low tone waveform data, it is set that the level of the characteristic B' is lower than the level of the characteristic A'. Further, in the loop section, since the quantity of loudness change of the component not more than the lowest frequency included in the loop section of the usual musical tone waveform data to be reproduced is substantially matched with the quantity of loudness change of the loop section of the pseudo low tone waveform data, it is set that the inclination of the characteristic B' is steeper than that of the characteristic A'. As a result, in the channel number a2, it is possible to obtain the pseudo low tone waveform in which the loudness characteristic follows with respect to the component not more than the pseudo low tone start frequency included in the musical tone signal produced by the channel number a1.

Moreover, the sound volume coefficient RVOL is multiplied with the thus obtained sound volume envelope of the channel number a2. As a result, it is possible to ease changes in the sound quality with respect to the note number NN in the vicinity of the lowest frequency, thereby producing a natural musical note signal.

(4) Other parameters.

The contents of other various types of parameters are basically set as similar to those of the channel number a1.

Again referring to FIG. 18, when the processing advances to the step SQ38, initiation of vocalization is commanded with respect to the channel numbers a1 and a2 in the sound source. Then, the processing relative to the note on even is completed. Thereafter, in the channel number a1 of the sound source 110, the usual musical tone waveform data 138 is read out at a speed according to the note number NN, and the musical tone signal relating to the channel number a1 is sequentially produced without including the pseudo low tone. In synchronization with this, in the channel number a2, the pseudo low tone waveform data 152 according to the note number NN is read, and the pseudo low tone signal is sequentially generated. As a result, both the tome signals are sounded through the sound system 112. Although the components less than the lowest frequency or critical frequency in the musical tone signal is not reproduced in the sound system 112, a user can hear the pseudo low tone corresponding to the irreproducible component, and a user have an illusion as if this low tone component is reproduced.

As described above, according to this embodiment, since the sound volume envelope relating to the usual musical tone waveform and the sound volume envelope relating to the pseudo low tone waveform can be individually controlled, it is possible to control the sound volume level and the dynamic range in conformity to the equal loudness contour in accordance with respective situations.

6. Sixth Embodiment

A sixth embodiment according to the present invention will now be described. Although the hardware structure of the sixth embodiment is similar to that of the fifth embodiment, waveform data prepared for the waveform memory and a software structure for control are somewhat different from those of the fifth embodiment, and only differences will be explained.

(1) Waveform Data Generation Processing

Figure 19:
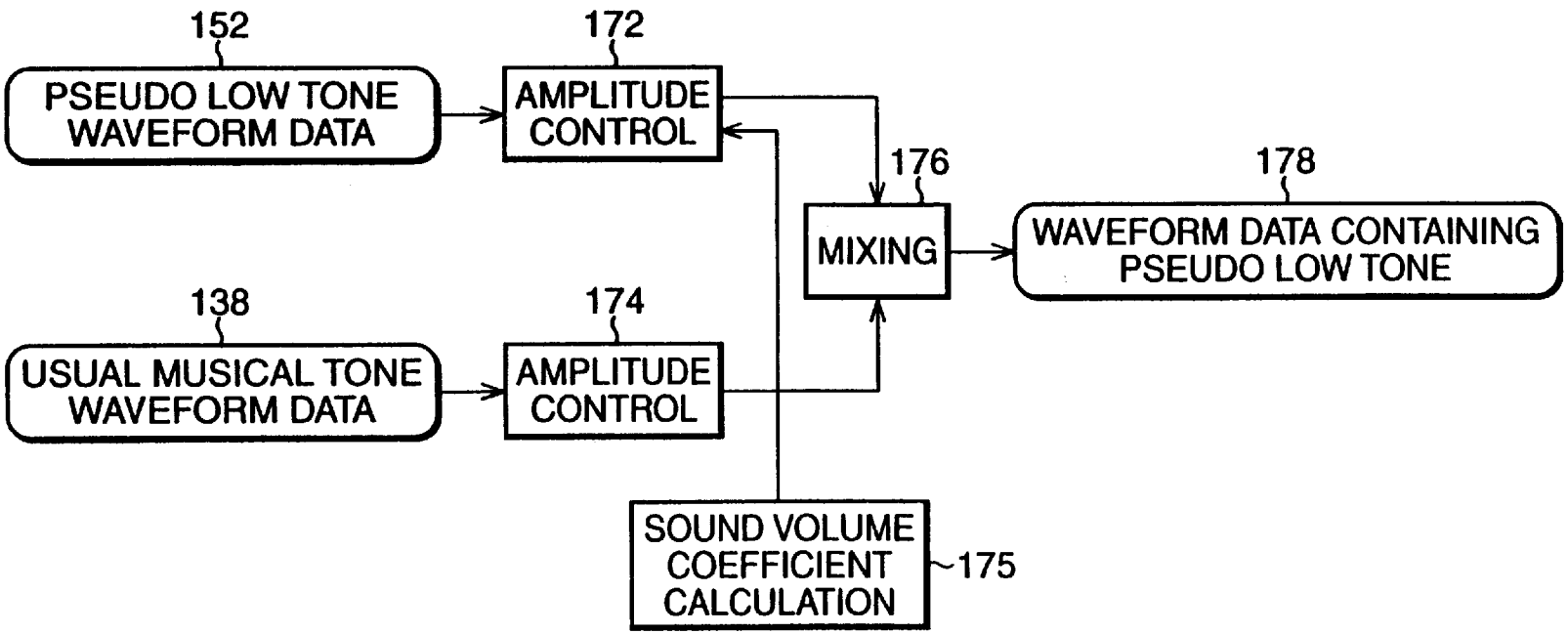
FIG. 19 is a block diagram showing a primary part of waveform data generation processing in a sixth embodiment.

In this embodiment, the waveform data generation processing similar to that described with reference to FIG. 15 is executed, thereby obtaining the usual musical tone waveform data 138 and the pseudo low tone waveform data 152. Further, in this embodiment, the processing illustrated in FIG. 19 is executed.

In the drawing, reference numeral 175 denotes a sound volume coefficient calculation portion for calculating the sound volume coefficient RVOL based on the sound volume coefficient characteristic (FIG. 16) when the note number NN is given. Reference numerals 172 and 174 designate amplitude control portions for controlling amplitudes of the waveform data 138 and 152. Moreover, in the amplitude control portion 172, the sound volume coefficient RVOL is multiplied with the obtained amplitude. That is, a difference in level of the characteristics A' and B' in FIG. 9 of the fifth embodiment corresponding to a difference between the attack sections is supplied to the envelopes of both the waveform data. Thereafter, the sound volume coefficient RVOL is multiplied in the amplitude control portion 172, thereby setting the amplitudes of both sets of the waveform data. Reference numeral 176 denotes a mixing portion for mixing both sets of the waveform data subjected to amplitude control and outputting a result as the waveform data 178 containing the pseudo low tone. These sets of waveform data 138 and 178 are stored in a hard disk of a personal computer, and the waveform data 52 is erased. In this manner, the usual musical tone waveform data 138 is mixed with the pseudo low tone waveform data 152 which corresponds to a frequency component not more than the pseudo low tone start frequency included in the data 138, and is subjected to amplitude control so as to obtain the equal loudness with this frequency component, thereby preparing the pseudo-low-tone-containing waveform data 178.

Here, in the method described in conjunction with FIG. 7, the sound pressure level is attenuated in order to adjust the loudness for the pseudo low tone, but the control of the degree of the change in the sound pressure level for uniforming the changes in the loudness is not executed. That is because a magnitude ratio of the change in the sound pressure level is close to 1 in "Robinson & Dodson", and it is hence judged that this control can be omitted. The generated usual musical tone waveform data 138 and the pseudo low tone inclusive waveform data 178 corresponding thereto are transferred to the waveform memory in the sound source 110 of the portable phone from the personal computer in accordance with a predetermined operation by a user. Although the usual musical tone waveform data 138 is stored in the waveform memory in the sound board 110 in accordance with each note range of the timbre, the pseudo low tone inclusive waveform data can be prepared for the usual musical tone waveform data 138 whose fundamental wave component is used for the musical tone generation with a pitch less than the lowest frequency, and stored in the waveform memory.

(2) Note-on-event Processing

Figure 20:
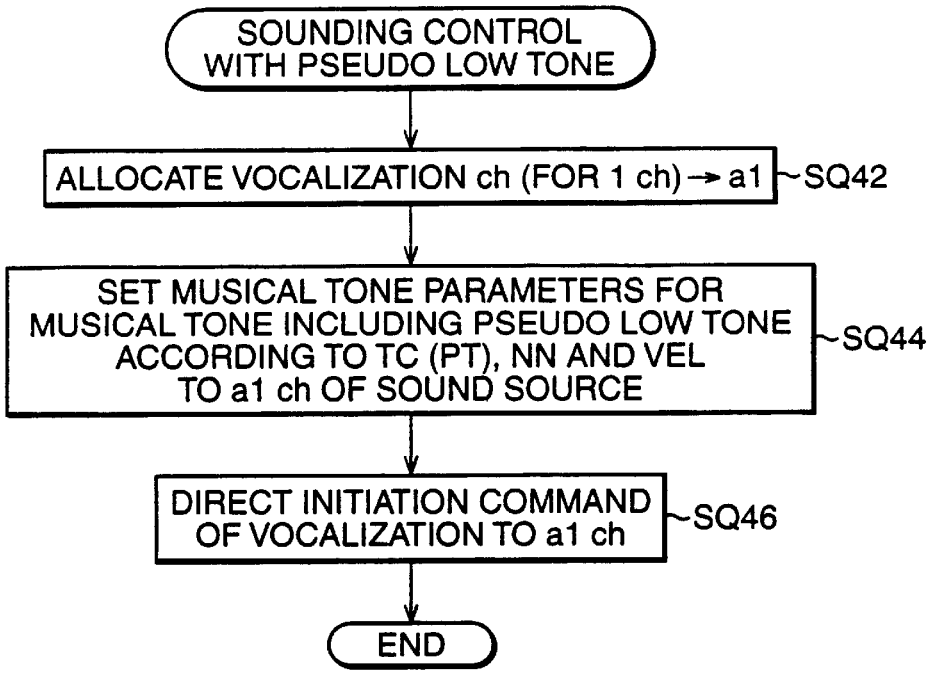
FIG. 20 is a flowchart of a sounding control routine with a pseudo low tone in the sixth embodiment.

In this embodiment, when a note on event occurs, the note-on-event processing routine shown in FIG. 17(*a*) is activated as similar to the fifth embodiment. The processing of the step SQ10 executed when the pseudo low tone effect is in the off state or when the pseudo low tone effect is in the on state and a frequency component less than the pseudo low tone start frequency does not exist in a musical tone signal to be produced is completely the same as that in the fifth embodiment. If the pseudo low tone effect is in the on state and an irreproducible frequency component in a low tone range is included in a musical tone signal to be generated, the sounding control routine with a pseudo low tone shown in FIG. 20 is called in place of the processing shown in FIG. 18 in the step SQ12.

The details of the steps SQ42, SQ44 and SQ46 executed in this routine are similar to those of the steps SQ22, SQ24 and SQ26 (FIG. 17(*b*)) respectively executed relative to the usual musical tone waveform. In the step SQ44, however, the address information, the F number, the sound volume envelope parameter and other parameters with respect to the pseudo low tone inclusive waveform data 178 instead of the usual musical tone waveform data 138 are set in the sound source 110. The address information to be set is address information of the pseudo low tone inclusive waveform data 178 corresponding to the usual musical tone waveform data 138 according to the note number NN among multiple sets of musical tone waveform data 138 corresponding to the timbre TC (PT) stored in the waveform memory. Basically, it is good enough that the F number, the sound volume envelope parameter and other parameters can have the same values as those of the corresponding parameters of the usual musical tone waveform data 138.

Consequently, in the step SQ46, when initiation of vocalization is commanded to the channel number a1 of the sound source, the pseudo-low-tone-containing waveform data 178 is read at a speed according to the note number NN in the sound source 110, and the filtering processing according to the above-mentioned tone filter parameter or the time-variable processing of the sound volume according to the sound volume envelope parameter is executed, thereby sequentially generating the musical tone signal relating to the channel number a1 with the pseudo low tone being included. Then, the musical tone signal is sounded through the sound system 112. Since this musical tone signal includes the pseudo low tone corresponding to a frequency component not more than the irreproducible lowest frequency, a user can hear the sound of this frequency component as if this component is reproduced. Further, with respect to a frequency component which is not less than the lowest frequency and not more than the pseudo low tone start frequency, the pseudo low tone waveform is generated in accordance with the sound volume coefficient characteristic (FIG. 16) in such a manner that the sound volume coefficient RVOL increases as the frequency lowers, and the changes in sound quality relative to the note number NN can be eased in around of the lowest frequency.

Consequently, in the step SQ46, when initiation of vocalization is commanded to the channel number a1 of the sound source, the pseudo low tone inclusive waveform data 178 is read at a speed according to the note number NN in the sound source 110, and the filtering processing according to the above-mentioned note filter parameter or the time-variable processing of the sound volume according to the sound volume envelope parameter is executed, thereby sequentially generating the musical tone signal relating to the channel number a1 with the pseudo low tone being included. Then, the musical tone signal is sounded through the sound system 112. Since this musical tone signal includes the pseudo low tone corresponding to a frequency component not more than the irreproducible lowest frequency, a user can hear the sound of this frequency component as if this component is reproduced.

According to this embodiment, even in case of generating a pseudo low tone, the vocalization channel allocated to one note-on-event can be restricted to one channel. Therefore, the present invention can be preferably used when restricting the increase in number of vocalization channels in particular.

7. Seventh Embodiment

A seventh embodiment according to the present invention will now be described. The hardware structure of the seventh embodiment is the same as that of the fifth embodiment except that the sound source 110 is not a waveform memory type sound source but a frequency modulation type sound source (FM sound source). Although the software structure is somewhat different from that of the fifth embodiment, only differences will be described hereinafter.

(1) Waveform Data Generation Processing

In this embodiment, since the musical tone signal is produced by the FM sound source system, the waveform data generation processing such as that in the fifth and sixth embodiments is not executed.

(2) Usual Sounding control in Note-on-event Processing

In this embodiment, when a note on event occurs, the note-on-event processing routine shown in FIG. 17(*a*) is activated as similar to the fifth embodiment. However, in this embodiment, when a pseudo low tone should not be generated, the usual sounding control subroutine shown in FIG. 21(*a*) is called in the step SQ10.

Figure 21A:
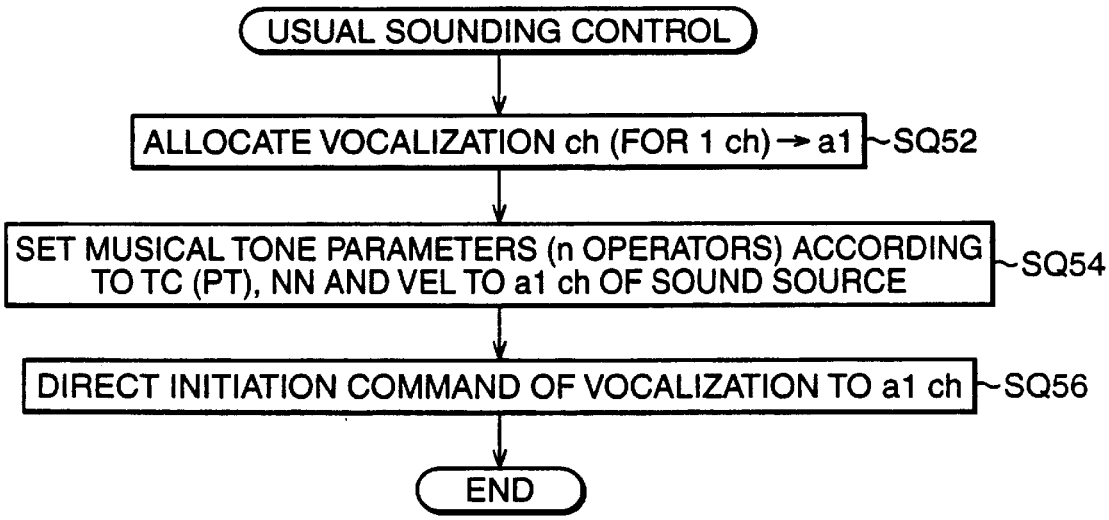
FIG. 21 is flowcharts of a control routine in seventh and eighth embodiments.
Figure 21B:
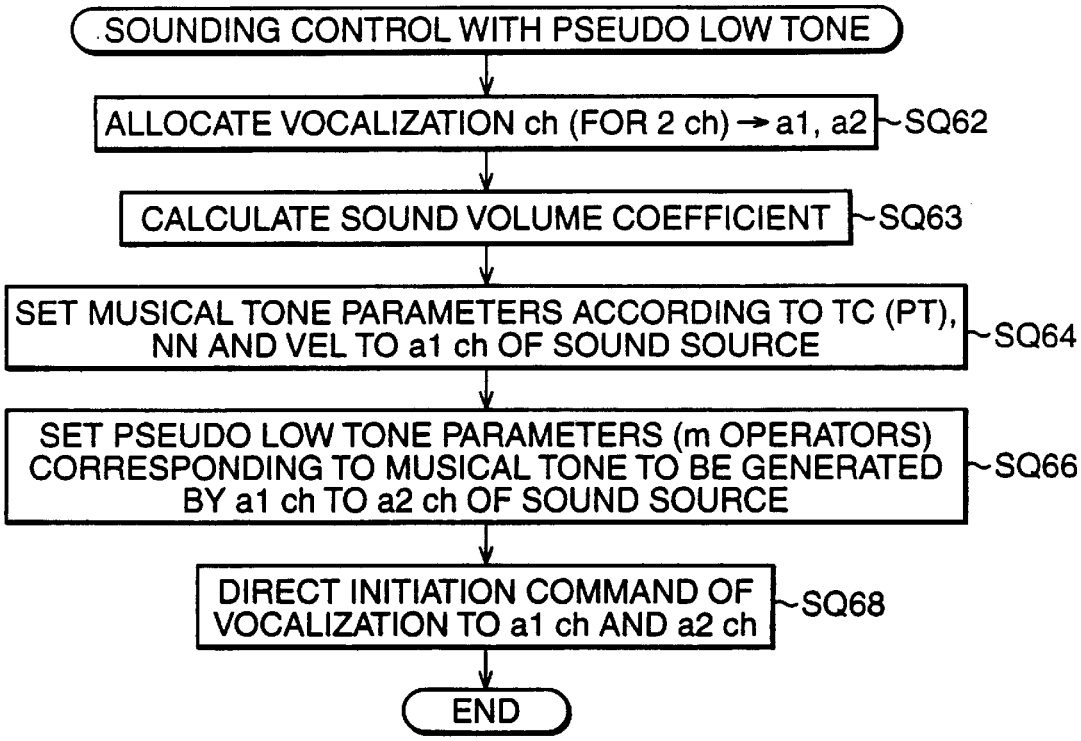
Figure 21C:
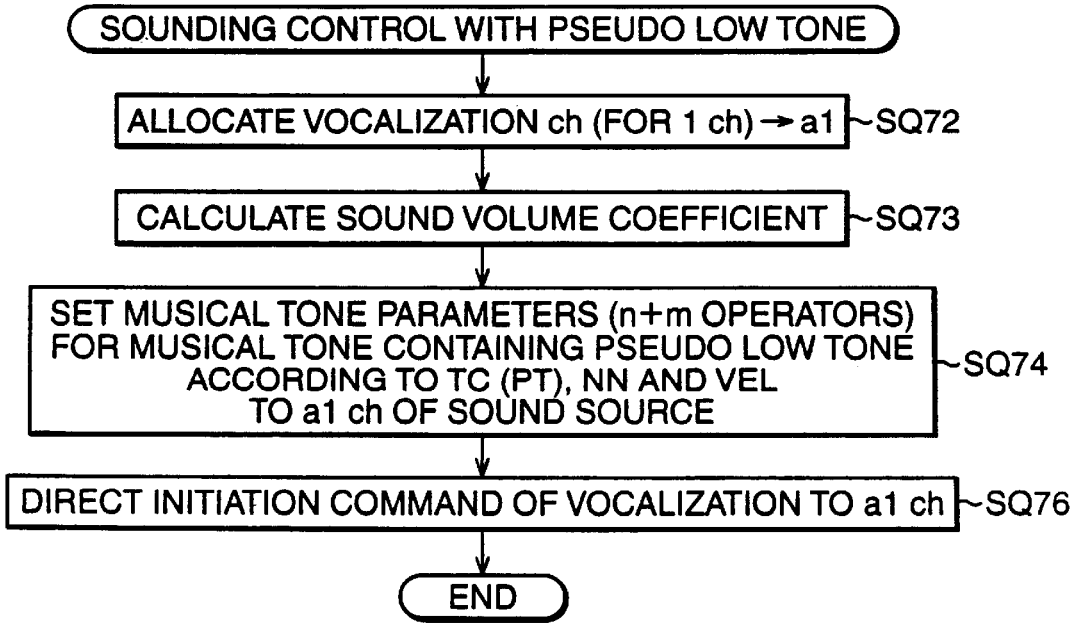

When the processing advances to the step SQ52 in FIG. 21(*a*), one vocalization channel is allocated in the sound source 110. The channel number of this allocated vocalization channel is determined as a1.

Subsequently, when the processing proceeds to the step SQ54, the musical tone parameters for the musical tone signal according to the timbre TC (PT) corresponding to the part number PT, the note number NN and the velocity VEL are set with respect to the channel number a1 in the sound source. In general, the musical tone parameters of the FM sound source set to the sound source channel are prepared by adding correction (scaling) according to the note number NN and the velocity VEL with respect to the basic musical tone parameters for the musical tone signal based on the timbre data each set of which is prepared for each timbre TC. Here, as the musical tone parameters, there are the following types.

(1) Algorithm

In the FM sound source system adopted in this embodiment, an algorithm (connection state of n units of operators) is selected in accordance with the timbre TC (PT). Further, there are determined types of waveform data used by each operator (the sine wave, the half-wave rectified waveform of the sine wave, the full-wave rectified waveform of the sine wave and others), pitch data for controlling a speed of advance of phase data for generating the waveform data (controlling the pitch of the waveform data), a multiplier factor relative to the pitch data for each operator (the speed of advance of the phase data in each operator is controlled by a product of the multiplier factor and the pitch data), low-frequency modulation control data (controlling tremolo and others), an envelope parameter for controlling the envelope waveform given to the waveform data generated by each operator, and others in accordance with the note number NN and the velocity VEL. As the contents of the algorithm, various kinds of contents can be considered. As a simple example, serial connection of "n=2" operators OP1 and OP2 such as shown in FIG. 13(*a*) can be considered.

(2) Sound Volume Envelope Parameter

The envelope given by an operator in the final stage of the algorithm (in the illustrative example, OP2) corresponds to the sound volume envelope of the musical tone signal outputted from the FM sound source. As described above, the envelope parameter of the envelope is determined in accordance with the timbre TC (PT), the note number NN and the velocity VEL.

(3) Other Parameters

In case of effecting the filtering processing with respect to an output of the algorithm, the tone filter parameter and others according to the timbre TC (PT), the note number NN and the velocity VEL are set. Furthermore, a pitch envelope parameter for controlling the pitch envelope for fluctuating the pitch of the musical tone signal to be produced may be set in some cases.

Subsequently, when the processing proceeds to the step SQ56, initiation of vocalization is commanded to the channel number a1 of the sound source. Then, the processing of the note on event is completed. Thereafter, in the sound source 110, the musical tone signal concerning the channel number a1 is sequentially generated without including a pseudo low tone. Furthermore, the musical tone signal is sounded through the sound system 112. Even if a frequency component not more than the lowest frequency is included in this musical tone signal, this component is not reproduced by the sound system 112, and a user cannot hear that component.

(3) Sounding control with Pseudo low tone in Note-on-event Processing

When the processing advances to the step SQ12 in the note-on-event processing routine (FIG. 17(*a*)), the sounding control routine with a pseudo low tone shown in FIG. 21(*b*) is called. When the processing proceeds to the step SQ62 in the flowchart the two vocalization channels are allocated in the sound source 110. The channel numbers of the allocated vocalization channels are determined as a1 and a2. Subsequently, when the processing proceeds to the step SQ63, the sound volume coefficient RVOL is determined based on the note number NN, the timbre TC (PT) and the sound volume coefficient characteristic (FIG. 16).

When the processing proceeds to the step SQ 64, musical tone parameters for musical tone signals according to the timbre TC (PT) corresponding to the part number PT, the note number NN and the velocity VEL are set. The detail of the processing is similar to that in the above-described step SQ54. Subsequently, when the processing advances to the step SQ66, m units of operators for pseudo low tones are assured in the channel number a2 in accordance with the musical tone signals to be generated in the channel number a1, and their parameters are set.

Here, as the musical tone parameters set for the pseudo low tone, there are the following types.

(1) Algorithm

In order to generate a pseudo low tone, an algorithm (see FIG. 13(*b*)) having a structure in which two operators OP3 and OP4 are connected in parallel is set to the channel number a2.

A frequency component less than the pseudo low tone start frequency is included in the frequency component of the musical tone signal to be generated in the channel number a1. Here, it is assumed that an operator having a multiplier factor of the pitch data being 1 among operators in the last stage of the channel number a1 generates the lowest tone. In this case, pitch data having a frequency f corresponding to the note number NN which is the same as that of the channel number a1 is set to the channel number a2, and each operator of the channel number a2 appropriately sets a multiplier factor, thereby generating a harmonic tone of that frequency f. In each operator, the pitch of the waveform data to be generated becomes greater than the lowest frequency, and combinations of a plurality of multiplier factors are set such that the greatest common factor becomes "1" (for example, "2, 3", "3, 4", . . . ). As a result, the pitch frequencies of the signals to be actually generated are, for example, "2f, 3f", "3f, 4f", . . . .

(2) Sound Volume Envelope Parameter

When the timbre TC (PT), the velocity VEL and the note number NN are specified, a sound volume envelope parameter is determined in order to specify a sound volume envelope given to the operator for the pseudo low tone (in the illustrative example, OP3 and OP4). The relationship of the sound volume envelope between the channel number a1 and a2 is similar to that in the first and sixth embodiments. That is, the envelope parameter of the sound volume envelop which has the equal loudness relation with the sound volume envelope for the irreproducible low-range component included in the musical tone signal generated by the channel a1 is set to each of the two operators of the channel number a2. Here, the envelope parameters set to the respective operators are different from each other in accordance with the pitch of the waveform data to be generated by each parameter.

(3) Other Parameters

Besides, a tone filter parameter and others corresponding to the note number NN and the velocity VEL are set. If the pitch envelope is set to the channel number a1, setting the same pitch envelope to the channel number a2 can cause the pitch for the pseudo low tone generated by the channel number a2 to follow fluctuations in the pitch of the musical tone signal generated by the channel number a1. Here, the above-described musical tone parameter for the pseudo low tone can be created by the method similar to the musical tone parameter for the musical tone signal. Specifically, the data for the pseudo low tone is first caused to be included in the tone data, each set of which is prepared for each timbre TC. Correction (scaling) according to the note number NN and the velocity VEL is then added to the basic musical tone parameter for the pseudo low tone included in the timbre data, thereby generating the musical tone parameter for the pseudo low tone.

Again referring to FIG. 21(*b*), when the processing proceeds to the step SQ58, initiation of vocalization is commanded to the channel numbers a1 and a2 in the sound source. Then, the processing relative to the note on event is completed. Thereafter, the musical tone signal is sequentially generated without including the pseudo low tone in the channel number a1 of the sound source 110. In synchronization with this, the pseudo low tone signal according to the note number NN is sequentially produced in the channel number a2. When both the signals are sounded through the sound system 112, despite the fact that a frequency component less than the lowest frequency is not reproduced in the musical tone signal of the channel number a1, a user has an illusion as if that frequency component is heard by the pseudo low tone of the channel number a2. Moreover, with respect to a frequency component which is not less than the lowest frequency and not more than the pseudo low tone start frequency, the pseudo low tone waveform is generated in accordance with the sound volume coefficient characteristic (FIG. 16) in such a manner that the sound volume coefficient RVOL decreases as the frequency raises. Therefore, suddenchanges in sound quality relative to the note number NN can be eased in the vicinity of the lowest frequency.

8. Eighth Embodiment

An eighth embodiment according to the present invention will now be described. Although the hardware structure of the fourth embodiment is similar to that of the seventh embodiment, the software structure is somewhat different from that of the seventh embodiment, and description will be hence given as to only differences.

(1) Sounding control with Pseudo low tone in Note-on-event Processing

In this embodiment, when the processing proceeds to the step SQ12 in the note-on-event processing routine (FIG. 17(*a*)), the sounding control routine with a pseudo low tone shown in FIG. 21(*c*) is called. When the processing advances to the step SQ72 in the flowchart, one vocalization channel is allocated in the sound source 110. The channel number of the allocated vocalization channel is determined as a1. Subsequently, when the processing proceeds to the step SQ73, the sound volume coefficient RVOL is determined based on the note number NN, the timbre TC (PT) and the sound volume coefficient characteristic (FIG. 16).

Subsequently, when the processing proceeds to the step SQ74, (m+n) units of operators are assured with respect to the channel number a1 in the sound source. Here, in this embodiment, it is assumed that an FM sound source capable of changing a number of operators for each channel is used. "m" and "n" mean numbers of operators for the usual vocalization and for the pseudo low tone in the above-mentioned seventh embodiment. Then, musical tone parameters according to the timbre TC (PT) corresponding to the part number PT, the note number NN and the velocity VEL are set to these operators.

The algorithm set herein equals to one obtained by connecting the algorithm for the usual vocalization with the algorithm for the pseudo low tone in the seventh embodiment in parallel. FIG. 13(*c*) shows one example thereof. The setting of other musical tone parameters is similar to that of the seventh embodiment.

Subsequently, when the processing proceeds to the step SQ76, initiation of vocalization is commanded to the channel number a1 in the sound source. Then, the processing for the note-on-event is completed. Thereafter, the musical tone signal including the pseudo low tone is sequentially produced in the channel number a1 of the sound source 110.

As described above, a difference between the seventh and eighth embodiments lies in that two vocalization channels are assured or one vocalization channel is assumed when effecting the sounding control with the pseudo low tone. A choice of either embodiment may be determined based on whether a maximum number of operators per one channel is not less than "n+m". In the example shown in FIG. 13, if the maximum number of operators is "3", the structure of the seventh embodiment (FIGS. 13 (*a*)+(*b*)) must be necessarily adopted. Further, if the maximum number of operators is not less than "4", any of the embodiments can be adopted, but it is advantageous to adopt the eighth embodiment because a number of channels can be restricted.

9. Ninth Embodiment

A ninth embodiment according to the present invention will now be described. A hardware structure of the ninth embodiment is similar to that of the fifth embodiment except the sound source 110. However, when the note-on-event occurs, the processing similar to that in the steps SQ2 and SQ10 in FIG. 17(*a*) (steps SQ22 to SQ26 in FIG. 17(*b*)) is executed. That is, the software processing is not changed regardless of whether the pseudo low tone is to be generated in this embodiment.

Figure 22A:
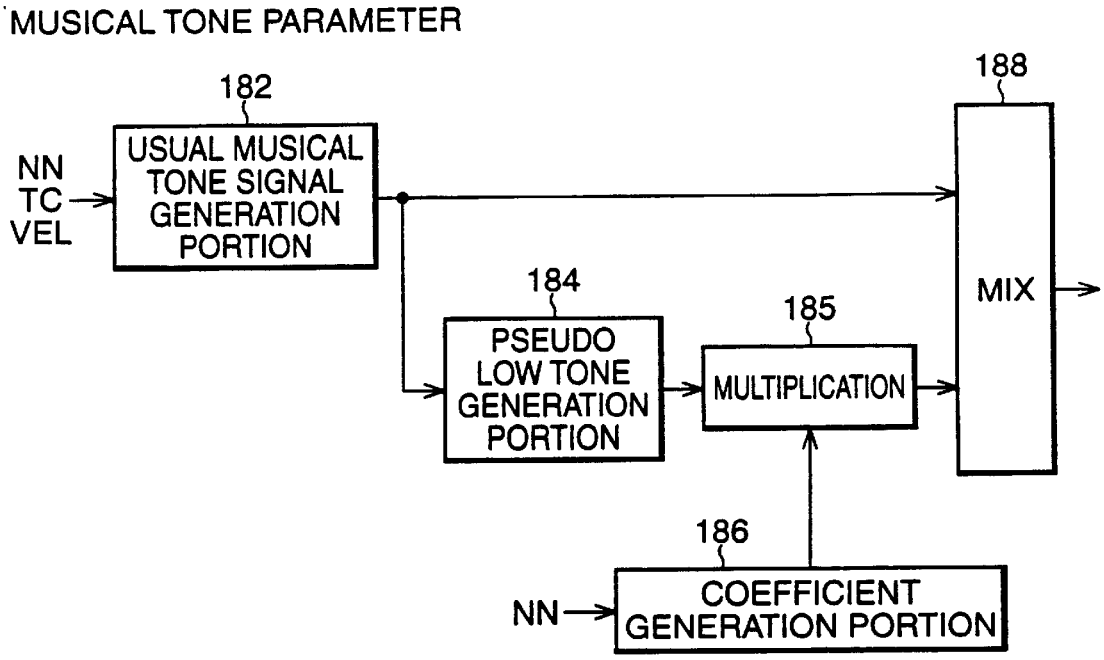
FIG. 22 is a block diagram showing a sound source of a ninth embodiment.
Figure 22B:
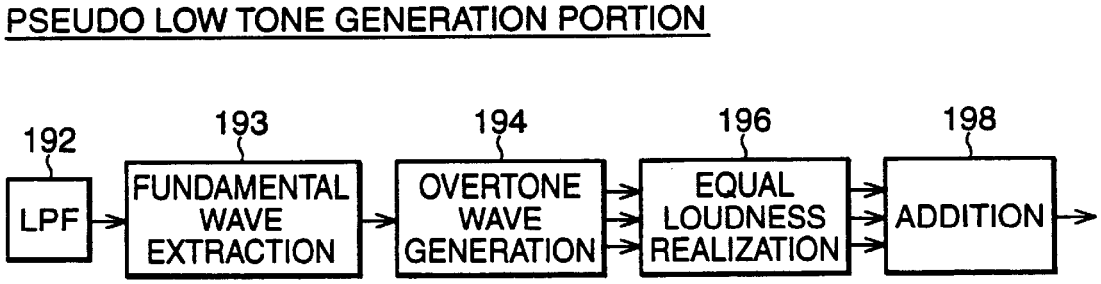

Here, the structure of the sound source 110 in this embodiment will now be described with reference to FIG. 22. In FIG. 22(*a*), reference number 182 designates an usual musical tone signal generation portion for generating an usual musical tone signal including no pseudo low tone based on the note number NN, the timbre TC (PT) and the velocity VEL. The usual musical tone signal generation portion 182 may generate the musical tone signal by any system such as a waveform memory type sound source or an FM sound source. Reference numeral 184 represents a pseudo low tone generation portion for generating a pseudo low tone signal in real time with respect to the usual musical tone signal sequentially outputted from the usual musical tone signal generation portion 182.

Here, the structure of the pseudo low tone generation portion 184 will now be described in detail with reference to FIG. 22(*b*). In the drawing, reference numeral 192 designates an LPF for extracting a component not more than the pseudo low tone start frequency from the usual musical tone signal. Reference numeral 193 denotes a fundamental wave extraction portion for extracting a fundamental wave component from an output signal of the LPF 192. Reference numeral 194 designates a overtone generation portion for generating a overtone wave of the fundamental wave component. For example, assuming that a frequency of the fundamental wave component is f, the overtone generation portion 194 extracts overtone components 2f, 3f, 4f, . . . . Reference numeral 196 designates an equal loudness realization portion for adjusting an amplitude of each overtone component in accordance with an equal loudness contour so as to obtain the same sound volume as that of the fundamental wave component. Reference numeral 198 represents an addition portion for adding each overtone component subjected to amplitude adjustment.

Again referring to FIG. 22(*a*), reference numeral 186 denotes a coefficient generation portion for outputting a sound volume coefficient RVOL based on a note number NN, the timbre TC (PT) and the sound volume coefficient characteristic (FIG. 16) supplied to the sound source 110. Reference numeral 185 designates a multiplication portion for multiplying the sound volume coefficient RVOL with the pseudo low tone signal outputted from the pseudo low tone generation portion 184. Reference numeral 188 represents a mixer for mixing the usual musical tone signal with the pseudo low tone signal and outputting the mixed result to the sound system 112.

According to this embodiment, since the pseudo low tone signal is generated based on the usual musical tone signal sequentially generated by the usual musical tone signal generation portion 182, the pseudo low tone can be produced without consuming further the vocalization channels or the musical tone generation time slots in order to generate the pseudo low tone. Furthermore, with respect to a frequency component which is not less than the lowest frequency and not more than the pseudo low tone start frequency, the pseudo low tone waveform is generated in accordance with the sound volume coefficient characteristic (FIG. 16) in such a manner that the sound volume coefficient RVOL increases as the frequency lowers. Accordingly, unease changes in sound quality relative to the note number NN can be eased in the vicinity of the lowest frequency.

Modifications

The present invention is not restricted to the foregoing embodiments, and various modifications of the present invention are possible as follows.

(1) Although each of the above-described embodiments carries out the present invention on the portable phone, the similar function may be used in various kinds of electronic instruments such as an amusement machine, a personal computer, or other devices for generating musical tones. Further, the software used in these devices may be stored in a storage medium such as a CD-ROM or a floppy disk to be delivered, or may be delivered through a transmission path of network.

(2) Although the coefficient generation portion 86 calculates the sound volume coefficient RVOL based on the note number NN and the timbre TC (PT) in the ninth embodiment, a frequency of the fundamental wave component extracted in the fundamental wave extraction portion 93 may be used instead. According to this structure, since the sound volume coefficient RVOL can be determined without using the musical tone parameters inherent to the sound source, an appropriate pseudo low tone can be given to an audio signal outputted from a source other than the sound source (for example, a record disk, a CD, wired/wireless broadcasting, a magnetic tape and others), thereby enabling the present invention to be extensively applicable.

(3) In each of the foregoing embodiments, a frequency (240 Hz) higher than the lowest frequency (120 Hz) by one octave is set as the pseudo low tone start frequency. However, the method for selecting the pseudo low tone start frequency is not restricted thereto, and that frequency may be set as a frequency higher than the lowest frequency by ½ octave or ¼ octave.

(4) In the above-described embodiments, a high pass filter for attenuating a frequency component not more than the lowest frequency which can be reproduced by the sound system may be provided between the sound source 110 and the sound system 112 so that the reproducible frequency component not more than the lowest frequency can be cut. As a result, the power consumption of an amplifier in the sound system 112 can be reduced.

(5) If the sound source 110 is a PCM sound source provided with a waveform RAM, the pseudo low tone waveform may be generated by analyzing the existing waveform data. At this time, a user may select or specify a reproducible lowest frequency, and the pseudo low tone waveform data may be automatically created based on the selected or specified lowest frequency.

(6) When applying the present invention to an electronic instrument, presetting of the pseudo low tone effect which matches with the sound system by a manufacturer is preferable if the present invention is incorporated in an electronic instrument provided with a sound system. In such a case, a plurality of types of setting may be prepared, and a user may select a preferable setting from them. On the other hand, in case of an electronic instrument provided with no sound system (for example, a synthesizer) or a sound source on a sound board of a personal computer, it is impossible to provisionally specify the sound system. In this case, as similar to the foregoing embodiments, setting of the lowest frequency of the pseudo low tone effect, a quantity of attenuation, a quantity of amplitude compress and others may be executed by a personal computer on which a panel or a sound board of an electronic instrument is mounted.

(7) In the foregoing embodiments, as parameters for generating a pseudo low tone, there are used the pseudo low tone start frequency, a quantity of attenuation (level L1 in FIG. 7), and a quantity of amplitude compress of a pseudo low tone (level ratio L3/L2 in FIG. 7). However, the quantity of attenuation and the quantity of amplitude compress may be determined as fixed parameters, and a pseudo low tone may be generated based on only the lowest frequency parameter. Alternatively, a pseudo low tone may be generated based on only the quantity of attenuation and the lowest frequency without taking changes in the amplitude compress in the pseudo low tone into consideration.

(8) In the above embodiments, if any of a plurality of sound systems is selectively switched to be used, the pseudo low tone start frequency for each sound system may be previously stored, and the pseudo low tone effect may be automatically set in accordance with the switching situation of the sound system to be used.

(9) The control data for controlling the pseudo low tone (pseudo low tone control data) may be included in a part of timbre data for each timbre. Moreover, a plurality of sets of pseudo low tone control data corresponding to different lowest frequencies may be included in that timbre data. In such a case, when a user specifies a critical frequency of the sound system 112 in advance, the pseudo low tone control data which matches with that lowest frequency can be thereafter automatically selected to be used by simply effecting the operation for selecting a timbre.

(10) In the seventh and eighth embodiments using the FM sound source, although the algorithm having two operators being connected in parallel for generating a pseudo low tone is used, any other algorithm may be used.

For example, in case of using an algorithm having two operators connected in series, it is good enough to set pitch data having the same pitch as that of a frequency of an irreproducible low-range component, generating waveform data with the same pitch as that of that frequency by the multiplier factor "1" in the operator on a modulator side, and generating the waveform data with the pitch which is twofold of that of the frequency by the multiplier factor "2"

in the operator on a carrier side. Applying frequency modulation to the waveform data having the double pitch by using the waveform data having the same pitch can generate a frequency component of a side band at intervals of a frequency corresponding to the same pitch with the double pitch in the center. It is possible to produce the pseudo low tone by using a carrier component having the double pitch and a side band component higher than the former pitch (having a pitch which is three-fold of a frequency of a irreproducible low-range component).

In this case, a sound volume ratio of the carrier component and the side band component which is higher by one unit is determined by an output level of the operator on the modulator side. In order to facilitate the control, it is preferable to cause no time-fluctuation of the envelope of the operator on the modulator side, i.e., determine the sound volume ratio as a fixed value.

Moreover, as to the envelope of the operator on the carrier side, it is good enough to set the envelope parameter so that changes with time can occur while maintaining the relation of the sound volume of the irreproducible low-range component and the equal loudness.

(11) In the above-described embodiments, although the pseudo low tone is generated by the waveform memory type sound source or the FM type sound source, types of the sound source are not restricted to these two types. For example, in case of a sound source adopting the harmonic synthesis system or the partial sound synthesis system, one or more operators among a plurality of oscillators for each channel can be used to produce the pseudo low tone. In case of a sound source adopting a ring modulation system, a overtone generated by the ring modulation of the two oscillator systems can be used as the pseudo low tone. In case of a sound source capable of effecting non-linear conversion of the waveform data, the pseudo low tone can be produced based on the overtone generated by the non-linear conversion. Besides, the present invention may be applied to a physical model sound source or an analog modeling sound source.

(12) In the foregoing embodiments, although the pseudo low tone effect can be turned on/off, it may be set so as to be constantly in the on state.

As described above, according to the present invention, since the first and second waveform signal are generated by making determination as to a specified pitch is not more than a predetermined critical pitch in connection with an electo-acoustic converter, it is possible to reduce a necessary quantity of arithmetic operation while generating the pseudo low tone.

What is claimed is:

1. A method of generating waveform signals from a plurality of channels to sound a music tone through an electro-acoustic converter in response to sounding instruction information, the method comprising:

a receipt process of receiving the sounding instruction information containing a designated pitch effective to specify a pitch of the music tone;

a determination process of determining whether or not the designated pitch is lower than a critical pitch which is predetermined in association with the electro-acoustic converter;

a first generation process of generating a first waveform signal containing a fundamental tone corresponding to the designated pitch at least when the determination process determines that the designated pitch is not lower than the critical pitch; and a second generation process of generating a second waveform signal containing at least two overtones which are multiples of the fundamental tone and higher than the critical pitch, only when the determination process determines that the designated pitch is lower than the critical pitch, thereby the second waveform signal providing a pseudo low tone below the critical pitch.

2. The method according to claim 1, wherein the first generation process generates the first waveform signal from a first channel even when the determination process determines that the designated pitch is lower than the critical pitch, and concurrently the second generation process generates the second waveform signal from a second channel different than the first channel, so that the first waveform signal and the second waveform signal are mixed with each other to provide the music tone containing the pseudo low tone.

3. The method according to claim 1, wherein the first generation process generates the first waveform signal by reading out first prestored waveform data and the second generation process generates the second waveform signal by reading out second prestored waveform data, the method further comprising a mix process of mixing the first waveform signal and the second waveform signal with each other when the determination process determines that the designated pitch is lower than the critical pitch, thereby providing the music tone containing the pseudo low tone.

4. The method according to claim 1, wherein the first generation process does not generate the first waveform signal when the determination process determines that the designated pitch is lower than the critical pitch, while the second generation process generates the second waveform signal containing the first waveform signal as well as the overtones, thereby providing the music tone containing the pseudo low tone.

5. The method according to claim 1, wherein the first generation process generates the first waveform signal by reading out first waveform data which is prestored and the second generation process generates the second waveform signal by reading out second waveform data which is a mixture of the first waveform data and additional waveform data corresponding to the overtones.

6. The method according to claim 1, wherein the first generation process generates the first waveform signal according to a waveform generation algorithm constituted by a plurality of operators, and the second generation process generates the second waveform signal according to another waveform generation algorithm constituted by a plurality of operators, the second generation process generating the overtones through a parallel connections of the operators assigned to the respective ones of the overtones.

7. The method according to claim 6, wherein the first generation process generates the first waveform signal by using operators belonging to a first channel, and the second generation process generates the second waveform signal by using operators belonging to a second channel different than the first channel.

8. A method of generating first and second waveform signals to output a music tone containing a pseudo low tone audible below a critical pitch, the method comprising:

a generation process of generating the second waveform signal which corresponds to the pseudo low tone and which differs from the first waveform signal corresponding to the music tone;

a coefficient generation process of generating a coefficient which gradually decreases in a predetermined pitch range around the critical pitch as a frequency of the second waveform signal increases;

a control process of controlling a level of the second waveform signal according to the generated coefficient; and an output process of outputting the second waveform signal concurrently with the first waveform signal, thereby providing the music tone and the pseudo low tone which fades out as a pitch of the music tone rises.

9. The method according to claim 8, further comprising an allocation process of allocating a channel to the waveform generation process and setting the allocated channel with tone generation parameters corresponding to the first waveform signal, wherein the output process commands the allocated channel to generate the second waveform signal containing the first waveform signal.

10. The method according to claim 8, wherein the waveform generation process comprises the steps of extracting a fundamental tone component from the first waveform signal which are provided sequentially, and generating at least overtone components of the extracted fundamental tone components so as to provide the pseudo low tone.

11. An apparatus for generating waveform signals from a plurality of channels to sound a music tone through an electro-acoustic converter in response to sounding instruction information, the apparatus comprising:

a receiver that receives the sounding instruction information containing a designated pitch effective to specify a pitch of the music tone;

a determination unit that determines whether or not the designated pitch is lower than a critical pitch which is predetermined in association with the electro-acoustic converter;

a first generator that generates a first waveform signal containing a fundamental tone corresponding to the designated pitch at least when the determination unit determines that the designated pitch is not lower than the critical pitch; and a second generator that generates a second waveform signal containing at least two overtones which are multiples of the fundamental tone and higher than the critical pitch, only when the determination unit determines that the designated pitch is lower than the critical pitch, thereby the second waveform signal providing a pseudo low tone below the critical pitch.

12. An apparatus for generating first and second waveform signals to output a music tone containing a pseudo low tone audible below a critical pitch, the apparatus comprising:

a generator that generates the second waveform signal which corresponds to the pseudo low tone and which differs from the first waveform signal corresponding to the music tone;

a coefficient generator that generates a coefficient which gradually decreases in a predetermined pitch range around the critical pitch as a frequency of the second waveform signal increases;

a controller that controls a level of the second waveform signal according to the generated coefficient; and an output unit that outputs the second waveform signal concurrently with the first waveform signal, thereby providing the music tone and the pseudo low tone which fades out as a pitch of the music tone rises.

13. A machine readable medium for use in a music apparatus having a processor, the medium containing program instructions executable by the processor for causing the music apparatus to perform a method of generating waveform signals from a plurality of channels to sound a music tone through an electro-acoustic converter in response to sounding instruction information, wherein the method comprises:

a receipt process of receiving the sounding instruction information containing a designated pitch effective to specify a pitch of the music tone;

a determination process of determining whether or not the designated pitch is lower than a critical pitch which is predetermined in association with the electro-acoustic converter;

a first generation process of generating a first waveform signal containing a fundamental tone corresponding to the designated pitch at least when the determination process determines that the designated pitch is not lower than the critical pitch; and a second generation process of generating a second waveform signal containing at least two overtones which are multiples of the fundamental tone and higher than the critical pitch, only when the determination process determines that the designated pitch is lower than the critical pitch, thereby the second waveform signal providing a pseudo low tone below the critical pitch.

14. A machine readable medium for use in a music apparatus having a processor, the medium containing program instructions executable by the processor for causing the music apparatus to perform a method of generating first and second waveform signals to output a music tone containing a pseudo low tone audible below a critical pitch, wherein the method comprises:

a generation process of generating the second waveform signal which corresponds to the pseudo low tone and which differs from the first waveform signal corresponding to the music tone;

a coefficient generation process of generating a coefficient which gradually decreases in a predetermined pitch range around the critical pitch as a frequency of the second waveform signal increases;

a control process of controlling a level of the second waveform signal according to the generated coefficient; and an output process of outputting the second waveform signal concurrently with the first waveform signal, thereby providing the music tone and the pseudo low tone which fades out as a pitch of the music tone rises.

15. A method of generating a musical tone from an original tone, said musical tone containing a pseudo low tone audible below a critical pitch, the method comprising the steps of:

acquiring original waveform data representative of the original tone;

analyzing a spectrum of the acquired original waveform data to identify a fundamental tone and at least two overtones of the identified fundamental tone; and generating synthetic waveform data representative of the pseudo low tone based on analysis of the spectrum of the original waveform data, said synthetic waveform data including wave data of said at least two overtones of the fundamental tone.

16. The method according to claim 15, wherein the acquiring step acquires the original waveform data, which presents a waveform of the original tone along a time axis, the analyzing step transforms the original waveform into frequency data, which presents frequency components of the spectrum of the original tone along a frequency axis, and the generating step generates the synthetic waveform data based on specific ones of the frequency components of the spectrum contained in the original tone.

17. The method according to claim 15, further comprising the step of storing the synthetic waveform data representative of the pseudo low tone in a first storing device for use in creation of the musical tone.

18. The method according claim 17, further comprising the steps of:

generating source waveform data based on the analysis of the original waveform data such that the source waveform data can be used in a sound source for reproduction of the original tone; and storing the source waveform data representative of the original tone in a second storing device for use in creation of the musical tone.

19. A method of generating a musical tone from an original tone, said musical tone containing a pseudo low tone audible below a critical pitch, the method comprising the steps of:

acquiring original waveform data representative of the original tone;

analyzing a spectrum of the acquired original waveform data;

generating synthetic waveform data representative of the pseudo low tone based on analysis of the spectrum of the original waveform data;

storing the synthetic waveform data representative of the pseudo low tone in a first storing device for use in creation of the musical tone;

generating source waveform data based on the analysis of the original waveform data such that the source waveform data can be used in a sound source for reproduction of the original tone;

storing the source waveform data representative of the original tone in a second storing device for use in creation of the musical tone; and mixing the stored synthetic waveform data and the stored source waveform data with each other to generate music waveform data representing the musical tone containing the pseudo low tone and the original tone.

20. A machine-readable medium containing a set of instructions executable by a processor in a tone generating apparatus for causing the tone generating apparatus to perform a method of generating a musical tone from an original tone, said musical tone containing a pseudo low tone audible below a critical pitch, said method comprising the steps of:

acquiring original waveform data representative of the original tone;

analyzing a spectrum of the acquired original waveform data to identify a fundamental tone and at least two overtones of the identified fundamental tone; and generating synthetic waveform data representative of the pseudo low tone based on analysis of the spectrum of the original waveform data, said synthetic waveform data including wave data of said at least two overtones of the fundamental tone.

21. A method of generating musical tones containing a pseudo low tone audible below a critical pitch and usual tones above the critical pitch, the method comprising the steps of:

providing a first waveform data representative of the pseudo low tone;

storing said first waveform data in a memory;

retrieving the first waveform data from the memory;

providing a second waveform data representative of the usual tones;

mixing the retrieved first waveform data with the second waveform data; and outputting musical tones containing the usual tones and the pseudo low tone based on the mixed first and second waveform data.

22. A machine-readable medium containing a set of instructions executable by a processor in a tone generating apparatus for causing the tone generating apparatus to perform a method of generating musical tones containing a pseudo low tone audible below a critical pitch and usual tones above the critical pitch, said method comprising the steps of:

providing a first waveform data representative of the pseudo low tone;

storing the first waveform data in a memory;

retrieving the first waveform data from the memory;

providing a second waveform data representative of the usual tones;

mixing the retrieved first waveform data with the second waveform data; and outputting musical tones containing the usual tones and the pseudo low tone based on the mixed first and second waveform data.

23. An apparatus for generating a musical tone containing a pseudo low tone audible below a critical frequency from an original tone above the critical frequency, the apparatus comprising:

an acquiring section that acquires original waveform data representative of the original tone;

an analyzing section that analyzes a spectrum of the acquired original waveform data to identify a fundamental tone and at least two overtones of the identified fundamental tone; and a generating section that generates synthetic waveform data representative of the pseudo low tone based on analysis of the spectrum of the original waveform data, said synthetic waveform data including wave data of said at least two overtones of the fundamental tone.

24. An apparatus for generating musical tones containing a pseudo low tone audible below a critical pitch and usual tones above the critical pitch, the apparatus comprising:

a waveform generation section for providing a first waveform data representative of the pseudo low tone and a second waveform data representative of the usual tones;

a storing section that stores first waveform data representative of the pseudo low tone;

a control section that retrieves the first waveform data from the storing section and that mixes the retrieved first waveform data with the second waveform data representative of the usual tones; and an output section that outputs musical tones containing the usual tones and the pseudo low tone based on the mixed first and second waveform data.

* * * * *